US008205371B1

(12) United States Patent
Cook et al.

(10) Patent No.: US 8,205,371 B1
(45) Date of Patent: Jun. 26, 2012

(54) RECOIL REDUCING SYSTEMS FOR A STOCK

(75) Inventors: Clifton L. Cook, Boise, ID (US); Thomas M. Gregory, Belgrade, MT (US); Robert A. Kincaid, Bozeman, MT (US); Kurtis Sparing, Belgrade, MT (US); Eric M. Yeates, Virginia Beach, VA (US); Birten L. Todd, Harrison, MT (US); Gary Cauble, Chesapeake, VA (US); Chris Michaels, Belgrade, MT (US); James K. Bentley, Paso Robles, CA (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 12/657,652

(22) Filed: Jan. 25, 2010

Related U.S. Application Data

(63) Continuation-in-part of application No. 12/008,558, filed on Jan. 11, 2008, now Pat. No. 7,685,755, which is a continuation-in-part of application No. 11/132,872, filed on May 19, 2005, now Pat. No. 7,340,857.

(51) Int. Cl.
*F41C 23/06* (2006.01)

(52) U.S. Cl. ..... 42/1.06; 42/74

(58) Field of Classification Search ..... 42/1.06, 42/74, 90
See application file for complete search history.

(56) References Cited

U.S. PATENT DOCUMENTS

| | | | | |
|---|---|---|---|---|
| 3,207,496 | A * | 9/1965 | Hrebicek | 267/172 |
| 3,208,179 | A * | 9/1965 | Hrebicek | 42/74 |
| 5,722,195 | A * | 3/1998 | Bentley et al. | 42/74 |
| 7,673,413 | B2 * | 3/2010 | Bentley | 42/75.03 |
| 7,685,755 | B1 * | 3/2010 | Bentley | 42/1.06 |
| 2004/0031182 | A1 * | 2/2004 | Bentley | 42/74 |
| 2009/0300962 | A1 * | 12/2009 | Bentley | 42/73 |

* cited by examiner

*Primary Examiner* — Bret Hayes
(74) *Attorney, Agent, or Firm* — Wooten & Shaddock, PLC

(57) ABSTRACT

A recoil reduction system having a stock with a track formed therein and extending a bottom wall; a sliding member that includes a rail extending from the right side and the left side of the rail, and wherein the sliding member is slidably received within the track by interaction of the track and the rail; a handgrip member formed as a portion of the stock, wherein the handgrip member includes a chamber that extends within the handgrip member; a first recoil reduction means mounted within the chamber, wherein the first recoil reduction means is configured to oppose sliding by the sliding member in at least one direction; and a second recoil reduction means mounted within the track, wherein the recoil reduction means is configured to oppose sliding by the sliding member in at least one direction.

15 Claims, 27 Drawing Sheets

RECOIL REDUCING SYSTEMS FOR A STOCK

CROSS-REFERENCE TO RELATED APPLICATIONS

This is a Continuation-In-Part of U.S. patent application Ser. No. 12/008,558, filed Jan. 11, 2008, now U.S. Pat. No. 7,685,755, which is a Continuation-In-Part of U.S. patent application Ser. No. 11/132,872, filed May 19, 2005, now U.S. Pat. No. 7,340,857, the disclosures of which are incorporated herein in their entireties by reference.

BACKGROUND OF THE INVENTION

1. Field of the Invention

The present invention is directed generally to a recoil reduction system. More specifically, the present invention is directed to recoil reduction systems that are embedded within the stock and/or grip of a firearm or other device.

2. Description of Related Art

The invention relates to firearms and more specifically to a recoil system for firearms. One age-old problem that has existed with firearms or other similar devices is the fact that many of them deliver severe recoil that affects the person firing the weapon. In firearms such as shotguns and rifles, the rear end of the butt stock is positioned against the shooter's shoulder and, when discharged, recoil from the discharge applies a centrifugal force to the firearm, often causing the front of the firearm to rise each time the weapon is fired. Also recoil varies depending upon the amount of explosive being fired and the recoil can result in pain and/or bruising to the shoulder area of the person firing the weapon. One example of the recoil being detrimental to a shooter's accuracy is where the firearm is a shotgun being used for skeet shooting by a male or a female.

In the past, recoil systems for the butt stock of a firearm did not function to effectively reduce the amount of recoil delivered to the shooter. Two examples of expensive systems are a hydro-coil fluid dampening system and a pneumatic air chamber system. The present inexpensive recoil systems utilize compression coil springs to absorb the recoil forces. If the compression coil spring is a little too strong, you get more recoil than with a regular firearm. If the compression coil spring is not strong enough it is worse, in that it gives the gun some travel and it is the same as holding the butt stock too loosely.

One improvement in recoil systems for a firearm is illustrated in the Bentley et al. U.S. Pat. No. 5,722,195. It has a pistol grip recoil assembly having a recoil base member and a pistol grip. The recoil base member is detachably secured to the rear end of the receiver of the firearm and it has an inverted T-shaped rail formed on its bottom wall. This inverted T-shaped rail is captured within and slides in an inverted T-shaped groove in the top end of the pistol grip. A recess formed in the front wall of the pistol grip adjacent its top end allows the trigger guard of the firearm to travel rearwardly with respect to the pistol grip when the firearm is fired. Various embodiments utilize springs to return the recoil base member forwardly to its static position after dissipating the recoil of the firearm resulting from its being fired.

Another recent improved recoil system for a firearm is illustrated in the Bentley et al. U.S. Pat. No. 5,752,339. This patent discloses a recoil system for the butt stock of a firearm having a recoil suppressor assembly whose front end is mounted in the cavity in the rear end of the gun stock. The piston ram of the recoil suppressor assembly in its static position extends rearwardly into a bore hole cavity of a elongated recoil housing. When the firearm is shot, the elongated body portion of the recoil suppressor assembly and its transversely extending mounting flange portion instantaneously travel rearwardly into the bore cavity with the bore hole of the body housing reciprocally traveling over the piston ram. A coil spring whose front end is secured to the front end of the body portion whose rear end is secured to a cam assembly returns the elongated body portion to a static position once the recoil of the firearm has been suppressed.

The present invention is directed to overcoming, or at least reducing the effects of one or more of the issues set forth above.

SUMMARY OF THE INVENTION

One embodiment of the invention is a recoil reduction system comprising a firearm stock that includes a handgrip member having a top end, a bottom end, and a chamber that extends within the handgrip member, wherein a track is formed in the top end of the handgrip member. A sliding member may be slidably connected to the track and a mounting means may be connected to the sliding member. The mounting means may be configured to connect to a firearm. A recoil reduction means may be mounted within the chamber and may be configured to oppose sliding by the sliding member.

The recoil reduction means may comprise a torsion spring connected to a cam. The torsion spring and the cam may pivot about the same axis. The recoil reduction means may have substantially no linear rebound.

Another embodiment of the invention is a recoil reduction means comprising a camming member having a first end, a middle, and a second end, a pivot pin pivotally securing the camming member to a recoil reduction means housing, a spring connected to the camming member, and a sliding member that may be configured to be slidably connected to a forend. The camming member and spring may be configured to oppose sliding by the sliding member in at least one direction, and the first end of the camming member may be configured to interface with a surface of the sliding member.

The camming member may comprise a cam, and the spring may comprise a torsion spring. The recoil reduction means housing may comprise a handgrip member, having a top end. A track may be formed in the top end. The recoil reduction means may be mounted in a chamber that extends within the handgrip member, and the sliding member may be slidably connected to the track. The spring may comprise a coil spring, a threaded rod surrounded by a coil spring held in place by a nut, a leaf spring, an elastomeric block, or a torsion spring.

The recoil reduction means further comprises a recess or cavity formed in the stock. A compression spring is positioned with its front end positioned against the rear wall of the sliding member and its rear end positioned against the bottom wall of the cavity. The recoil of an attached firearm, when the firearm is fired, is dampened by compression spring. When the recoil force subsides, compression spring urges the sliding member to its forward, static position.

In one exemplary, nonlimiting embodiment, the recoil system has a sliding member and a handgrip member. An inverted T-shaped rail or slide is formed along the side walls of the sliding member. The stock includes an inverted T-shaped groove or track in which the T-shaped rail of sliding member travels axially. A cavity is formed in the bottom of the inverted T-shaped rail found on the bottom wall of sliding member. Handgrip member has a chamber extending from its top end down to its bottom end. A coil spring has a lower hook portion formed on its bottom end that is captured by a retainer pin secured transversely to interior of handgrip member. The top end of spring has an upper hook portion that is captured by a pin passing through the camming member. A pivot pin extends transversely with its opposite ends rigidly secured to the inside of handgrip member. A pair of upper bi-furcated arms have a cam roller secured thereto by a pin.

Recoil caused by the firing of the weapon causes sliding member to travel rearwardly which also forces cam roller rearwardly as cavity moves rearwardly. This travel rearwardly of cam roller causes the camming member to pivot rearward causing the spring to be stretched upwardly and absorb most of the recoil of the weapon.

The novel recoil reduction system has been designed to be used as a stock for firearms such as shotguns and rifles.

Accordingly, this invention provides a novel recoil system for a firearm that reduces the amount of recoil force experienced by the person firing the weapon.

This invention separately provides a novel recoil system for a firearm that reduces pain to the shoulder of the person firing the weapon due to recoil forces.

This invention separately provides a novel recoil system for a firearm that can easily be installed on the firearm.

This invention separately provides a novel recoil system incorporated into a stock of a firearm.

This invention separately provides a novel recoil system for shotguns and rifles that is economical to manufacture.

This invention separately provides a double recoil system for a firearm.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 1:
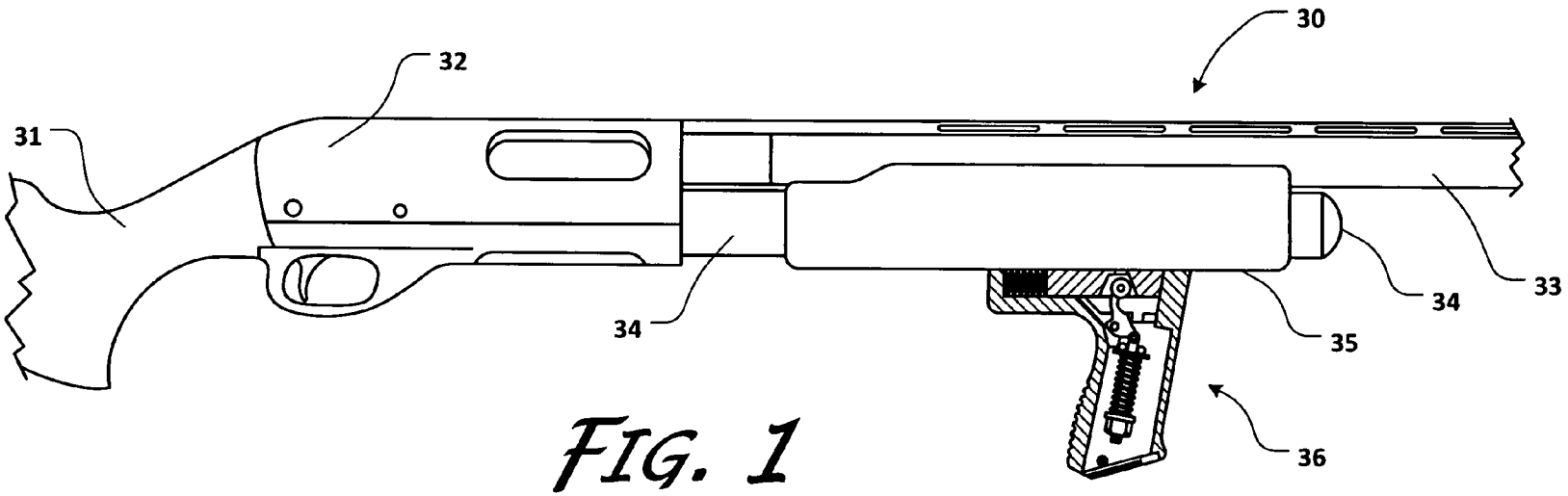
FIG. 1 shows a side elevation view of a shotgun illustrating the recoil reduction system mounted in a handgrip member secured to the bottom of the forend.
Figure 5:
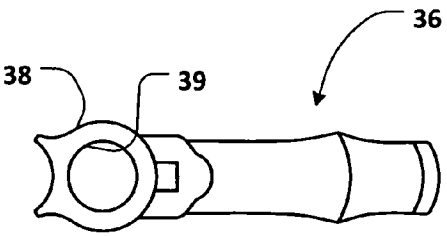
FIG. 5 shows a front elevation view of FIG. 2.
Figure 3:
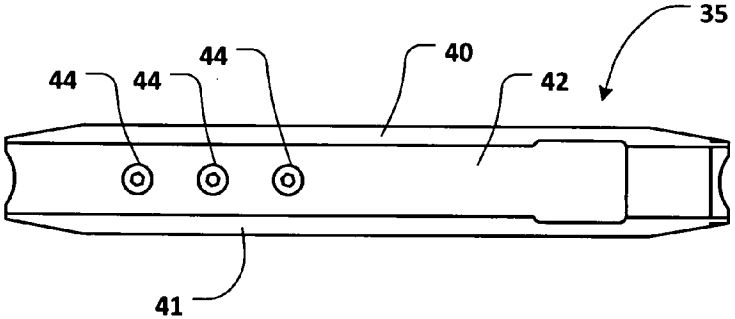
FIG. 3 shows a top plan view of the forend illustrated in FIG. 2.

The novel recoil reduction system for a firearm will now be described by referring to FIGS. 1-9 and 18-19. A shotgun 30 is illustrated in FIG. 1 having butt stock 31, a receiver 32, a gun barrel 33, a magazine 34, a forend 35 and a handgrip member 36. The recoil reduction system is mounted within handgrip member 36.

Figure 4:
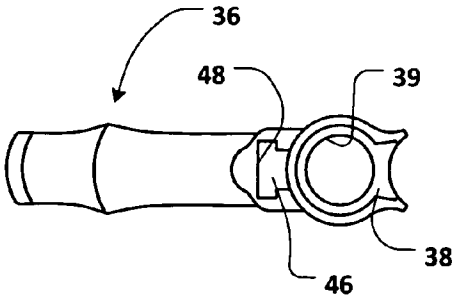
FIG. 4 shows a rear elevation view of FIG. 2.
Figure 2:
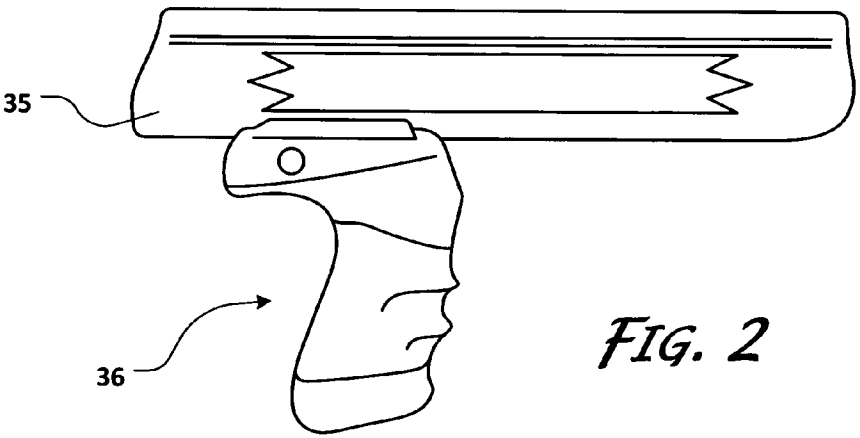
FIG. 2 shows an enlarged side elevation view of a forend having the recoil reduction system mounted in the handgrip member.

FIGS. 1-6 and 18-19 illustrate views of the forend 35 from various sides and angles. FIG. 4 shows a rear elevation view and it shows that forend 35 has a generally U-shaped transverse profile with a ring 38 formed at its front end. Ring 38 has a bore hole 39 that would telescope over magazine 34, as shown in FIG. 1. The remainder of forend 35 has a left side wall 40, a right side wall 41, and a bottom wall 42. A plurality of screws 44 secure an inverted T-shaped rail 46 to the bottom surface of forend 35. Handgrip member 36 has a longitudinally extending inverted T-shaped track 48 along which rail 46 reciprocally travels.

Figure 6:
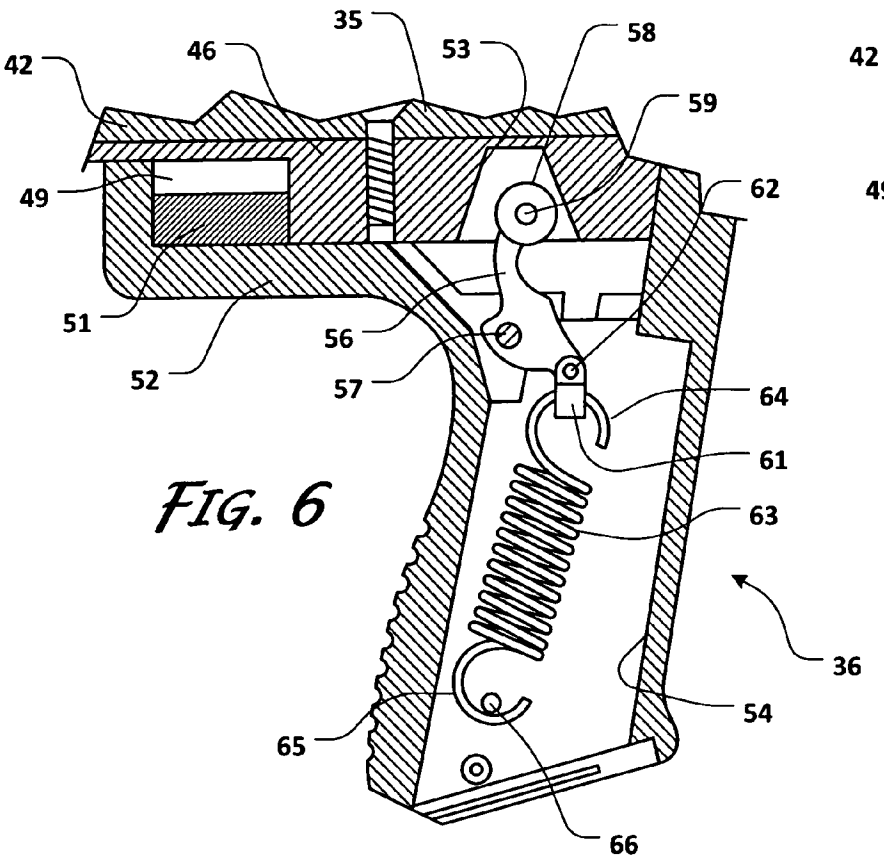
FIG. 6 shows a vertical cross section view illustrating a first embodiment of the recoil reduction system mounted in the handgrip member.

Track 48 has a chamber 49 (as shown in FIG. 6) formed in its rear end that receives an elastomeric block 51 having a cylindrical shape. Track 48 and chamber 49 are formed in track housing 52 that extends rearwardly from the top end of handgrip member 36. As shown in FIG. 6, a cam roller cavity 53 is formed in the bottom surface of rail 46. A primary chamber 54 extends upwardly through almost all of the height of handgrip member 36. A camming member 56 is pivotally mounted in primary chamber 54 by a pivot pin 57. A cam roller 58 is mounted on the top end of camming member 56 by a pin 59. A retainer ring 61 is mounted on the bottom end of camming member 56 by a pin 62. A coil spring 63 has its upper hook portion 64 captured in retainer 61. Coil spring 63 has a lower hook portion 65 captured by the rigid pin 66.

Forend 35 is rigidly secured to the magazine 34 or other structure that is rigidly secured to receiver 32. When the shotgun is fired, a forend 35 recoils rearwardly causing rail 46 to also travel in the same direction. The elastomeric block 51 is compressed to reduce some of the recoil. Cam roller 58 is pivoted rearwardly about pivot pin 57 causing coil spring 63 to be stretched and then returned to its static position and this also provides recoil reduction.

Figure 7:
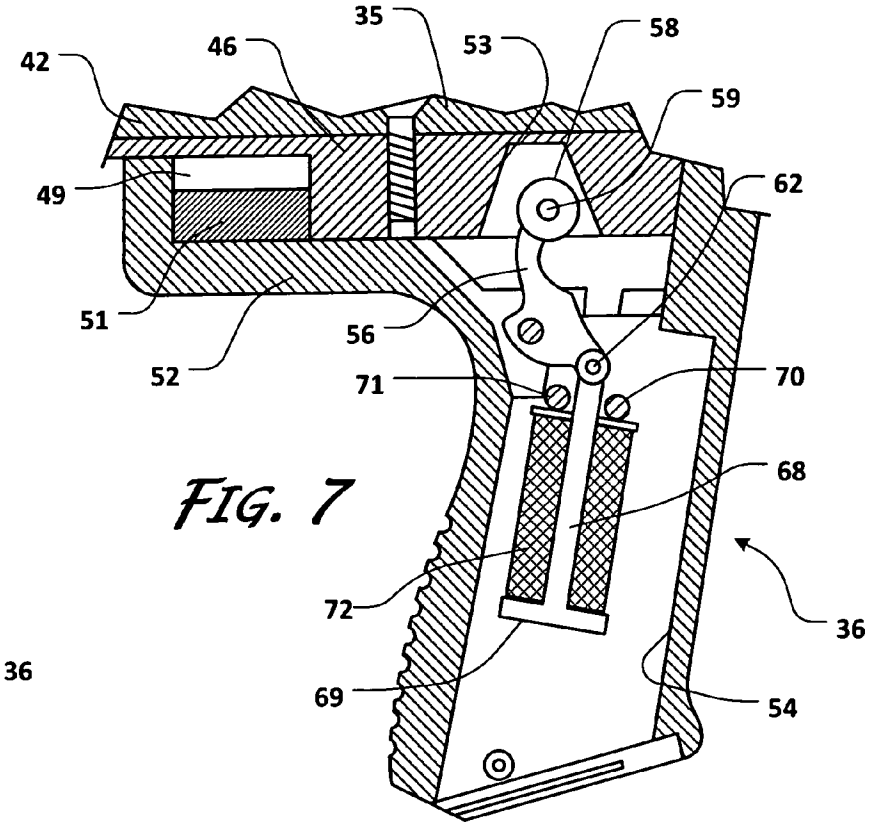
FIG. 7 shows a vertical cross section view illustrating a second embodiment of the recoil reduction system mounted in the handgrip member.

A first variation of the recoil reducing structure in the handgrip member 36 is illustrated in FIG. 7. A rod 68 has its bottom end connected to plate 69 and its top end is pivoted on pin 62. An elastomeric tube 72 is telescoped over rod 68 and its top end bears against pins 70 and 71. Rearward travel of rail 46 will pivot camming member 56 rearwardly causing elastomeric tube 72 to be compressed and reduce recoil.

Figure 8:
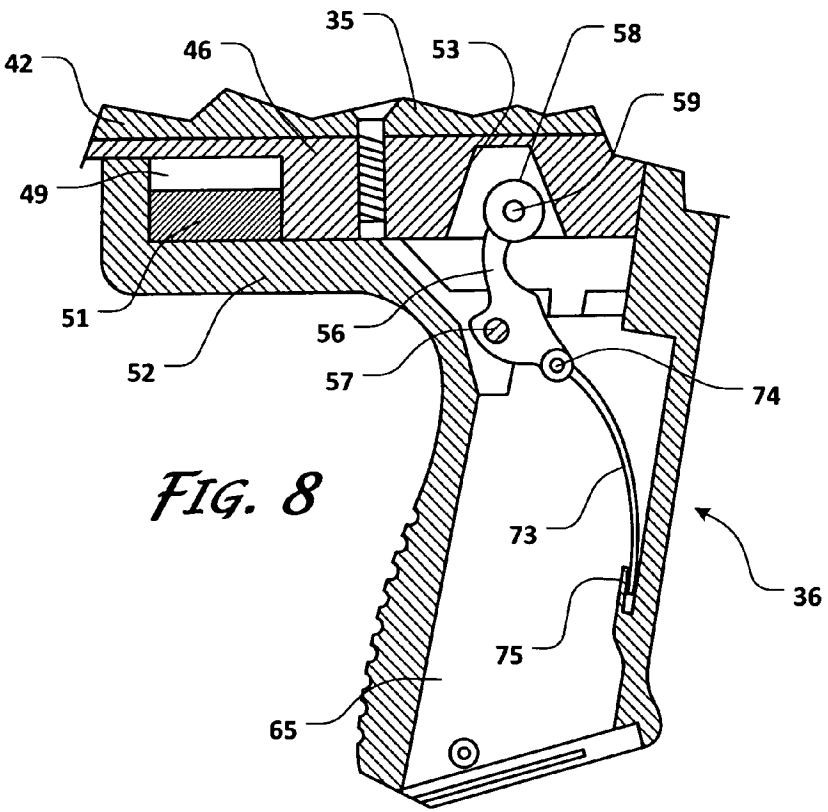
FIG. 8 shows a vertical cross section view illustrating a third embodiment of the recoil reduction system mounted in the handgrip member.

A second alternative recoil reducing structure is illustrated in FIG. 8. It has a leaf spring 73 having a stressed curvature in its static state. Its top end is captured by attachment structure 74 on the bottom end of camming member 56 and its bottom end is captured in slot 75 in the inner wall of handgrip member 36. Rearward travel of rail 46 will compress elastomeric block 51 causing recoil reduction. Likewise spring 73 will be stretched upwardly when camming member 56 is rotated rearwardly. This also reduces the recoil force.

Figure 9:
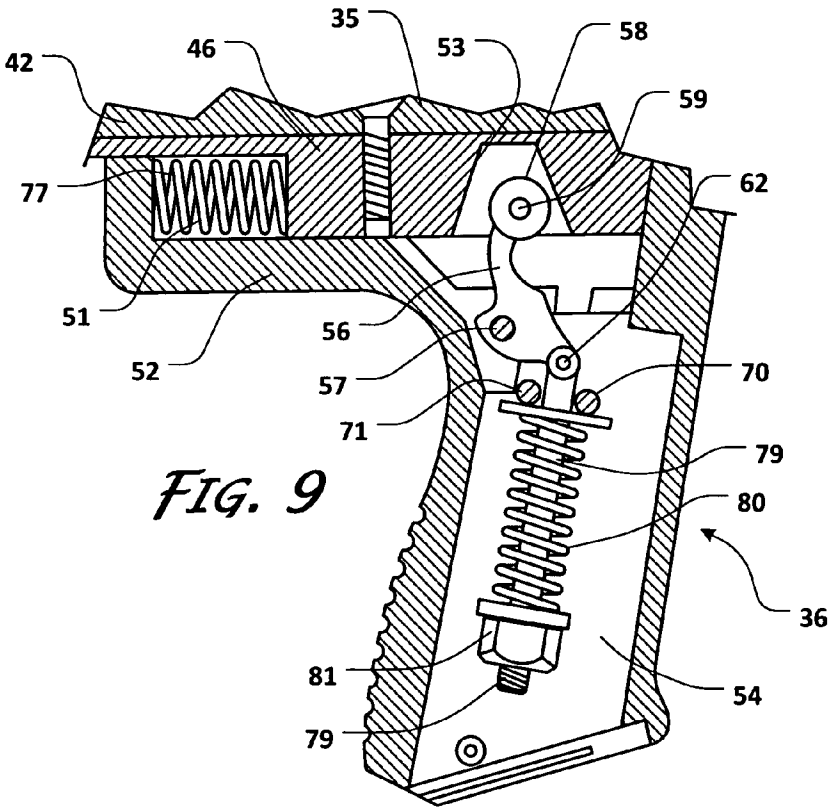
FIG. 9 shows a vertical cross section view illustrating a fourth embodiment of the recoil reduction system mounted in the handgrip member.

A third alternative recoil structure is illustrated in FIG. 9. It has a coil spring 77 in rail chamber 49. A screw 79 has its top end captured by pin 62. A coil spring 80 surrounds screw 79 and has a nut 81 on its bottom end. Pins 70 and 71 press against the top end of spring 80. When rail 46 travels rearwardly, coil spring 77 reduces the recoil force. Also as camming member 56 has its top end pivoted rearwardly, spring 80 would be compressed to also reduce recoil force.

Figure 10:
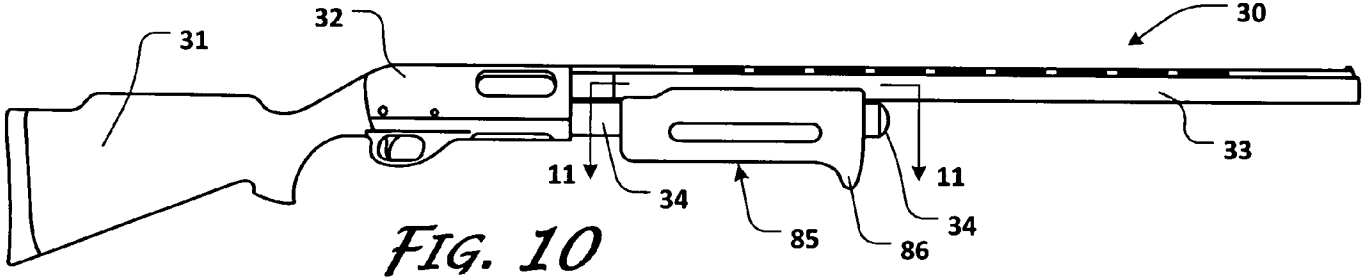
FIG. 10 shows a side elevation view of a shotgun illustrating the recoil reduction system mounted within the interior of the forend member.
Figure 11:
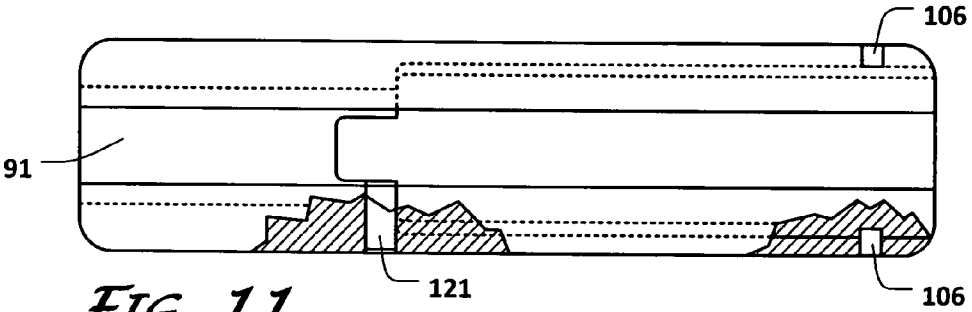
FIG. 11 shows a top plan view of the forend member illustrated in FIG. 10.
Figure 12:
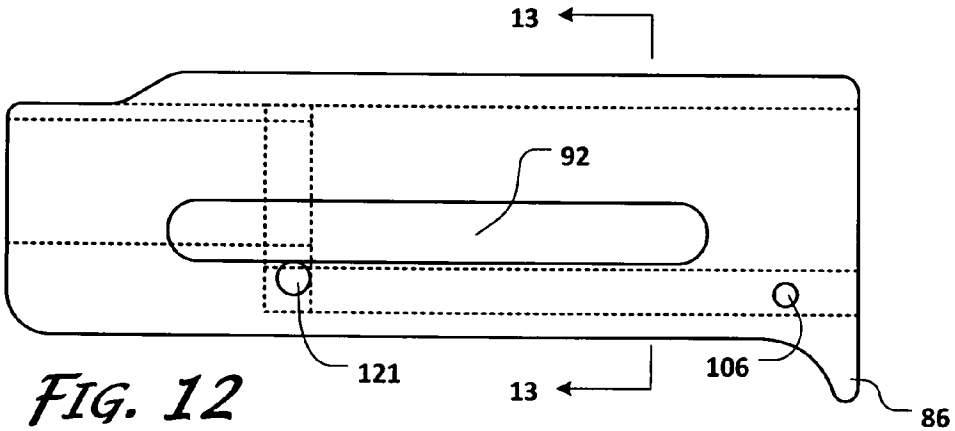
FIG. 12 shows a right side elevation view of the forend member illustrated in FIG. 10.
Figure 13:
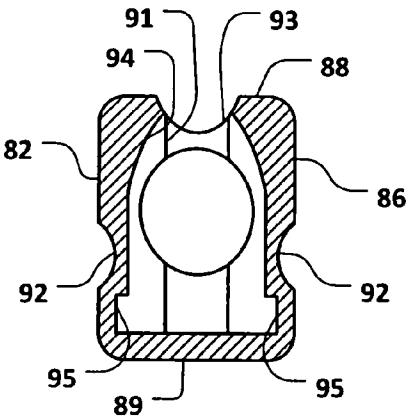
FIG. 13 shows a cross sectional view taken along lines 13-13 of FIG. 12.
Figure 15:
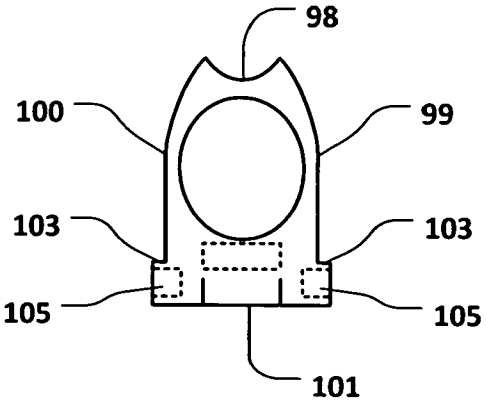
FIG. 15 shows a front elevation view of the support unit illustrated in FIG. 14.

In FIGS. 10-17, the recoil reduction system is mounted inside forend 85. Forend 85 has a handrest stop 86 extending downwardly from its forward end to prevent the shooter's hand from slipping off the forend. FIGS. 11-13 illustrate different views of the forend 85.

As shown in FIG. 13, the forend 85 is generally U-shaped throughout most of its length. It has a left side wall 86, a right side wall 82, a top wall 88, and a bottom wall 89. A portion of forend 85 has a connecting wall member 91 at its top end and a bore hole 93 is formed for telescopically receiving the magazine 34 (as shown in FIG. 10). Finger grooves 92 are formed along the outside surface of the respective left and right side walls. Forend 85 has an interior cavity 94 having outwardly extending tracks 95 adjacent its bottom end.

The structure for mounting the recoil reduction system is illustrated in FIGS. 14-17 and is generally identified as support unit 97. Support unit 97 is a solid piece of material that is telescopically received in cavity 94 (as shown in FIG. 13) of forend 85, as shown in FIG. 10. Support unit 97 has a top wall 98, a left side wall 99, a right side wall 100, a bottom wall 101 and rails 103 extend outwardly from the respective side walls adjacent bottom wall 101.

Figure 17:
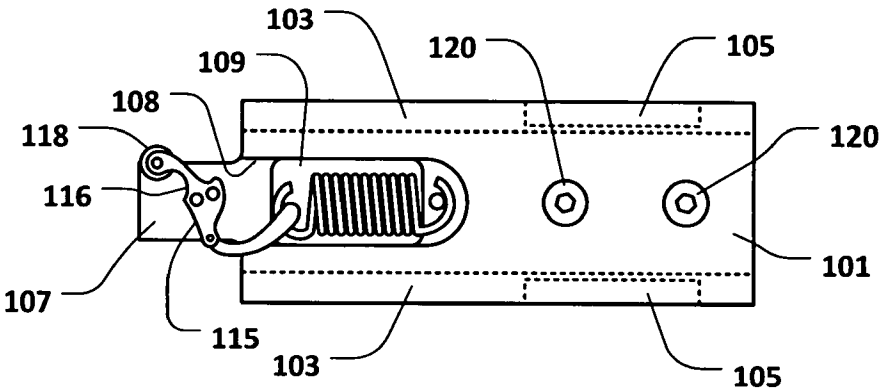
FIG. 17 shows a bottom plan view of the support unit illustrated in FIG. 14.
Figure 14:
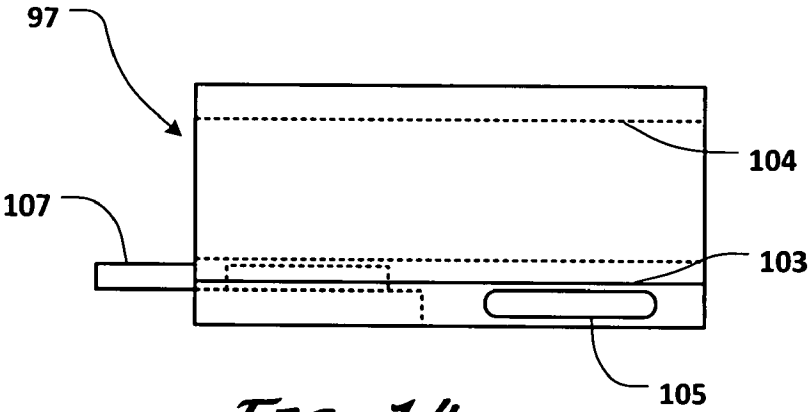
FIG. 14 shows a side elevation view of the support unit for the recoil reduction structure received in the forend illustrated in FIGS. 11-13.
Figure 16:
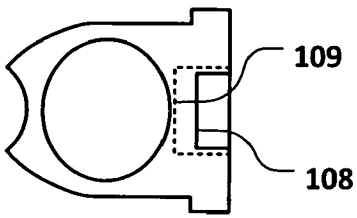
FIG. 16 shows a rear elevation view of the support unit illustrated in FIG. 14.
Figure 19:
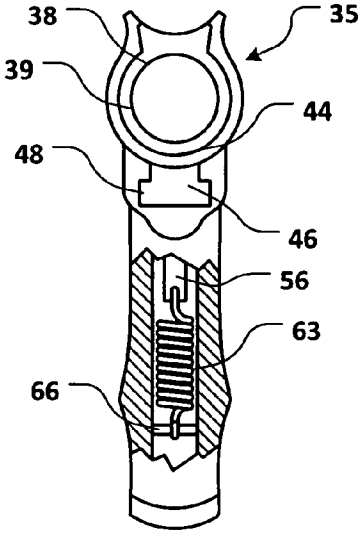
FIG. 19 shows a front elevation view of FIG. 18 with portions shown in cross section.
Figure 18:
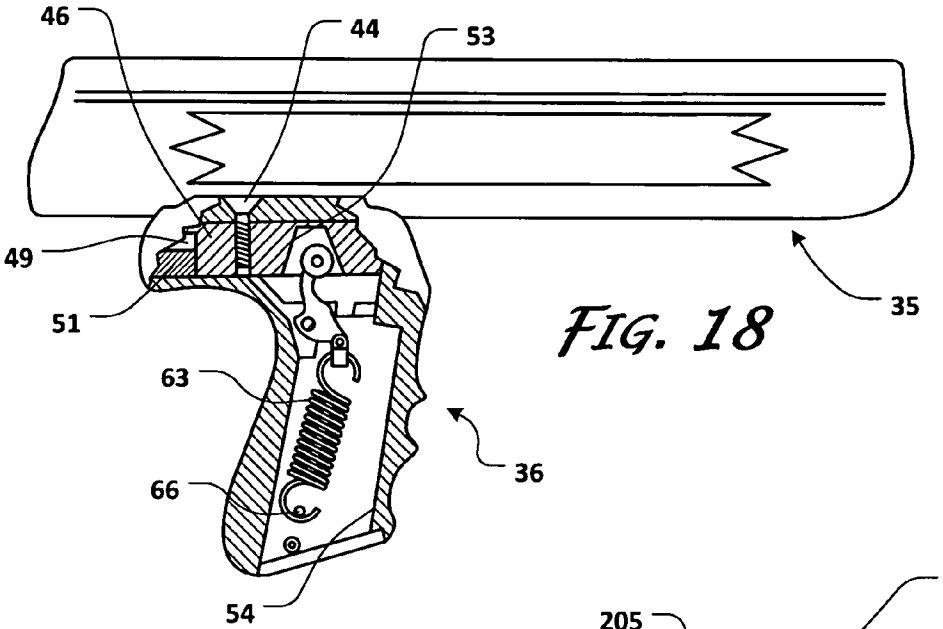
FIG. 18 shows an enlarged view of FIG. 2 with portions of the handgrip member illustrated in cross section.

A bore hole 104 extends the length of support unit 97 so that the support unit 97 telescopes over magazine 34, as shown in FIG. 10. Grooves 105 extend inwardly into rails 103 and these grooves receive set screws 106 (as shown in FIGS. 11 and 12) extending inwardly from the side walls of forend 85. Bottom wall 101 is best seen in FIG. 17. As shown in FIG. 17, a tongue 107 extends from a front end of the support unit 97. An outer cavity 108 is formed in bottom wall 101 for receiving part of the hardware of the recoil reduction system. A second deeper cavity 109 accommodates the bottom portion of coil spring 110. One end of coil spring 110 is secured to a pin 112 and the other end is secured to a retainer member 113 whose free end is secured to one end of the camming member 115. The camming member 115 is secured to tongue 107 by a pivot pin 116. A cam roller 118 is supported by a pin on the other end of the camming member 115. Attachment screws 120 secure support unit 97. As support unit 97 travels rearwardly, cam roller 118 engages pin 121 (as shown in FIG. 12) extending into the side wall of forend 85. It engages cam roller 118 causing it to rotate about pivot pin 116 causing spring 110 to be stretched and reduce recoil.

Figure 20:
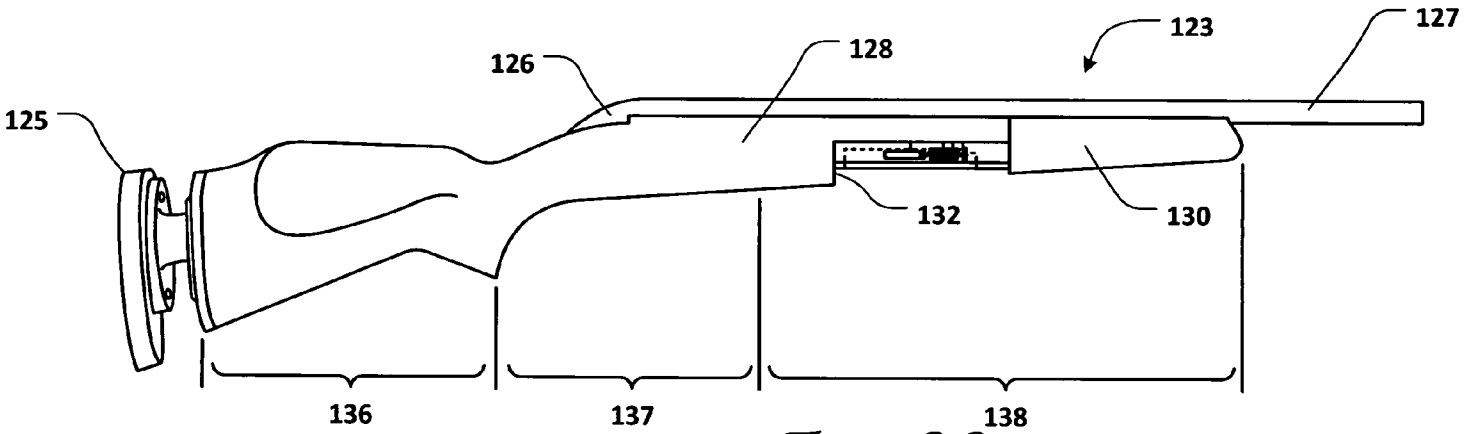
FIG. 20 shows a side elevation view of a rifle having the recoil reduction system positioned forwardly of the receiver in the bottom of the long gun stock.

In FIGS. 20-24, the recoil reduction system is mounted in a rifle 123. As shown in FIG. 20, rifle 123 has a recoil suppression butt stock assembly 125, a receiver 126, a gun barrel 127, and a long gun stock 128. For the embodiment to be discussed, long gun stock 128 would have a removable front piece 130. It is to be understood that a single long gun stock 128 could also have primary recess 132 integrally formed in a single long gun stock. In the illustrated embodiment, stock cover 134 (not shown) can only be installed by removing front piece 130. Long gun stock 128 has three identifiable portions, butt stock portion 136, middle portion 137, and front portion 138. Front portion 138 is located forward of receiver 128. Primary recess 132 has a bottom wall 140. Bottom wall 140 has rails 142 extending along its lateral edges and above it are formed an inwardly extending track 144 (not shown).

A recess 146 is formed in bottom wall 140 and the camming member 147 is mounted on a pivot pin 148 therein. A cam roller 149 is pivotally secured to one end of the camming member 147. A retainer member 150 is secured to the other end of 147 and it captures one end of spring 152. The other end of spring 152 is captured by a pin 153. The top portion of spring 152 extends into a deeper recess 155.

Figure 21:
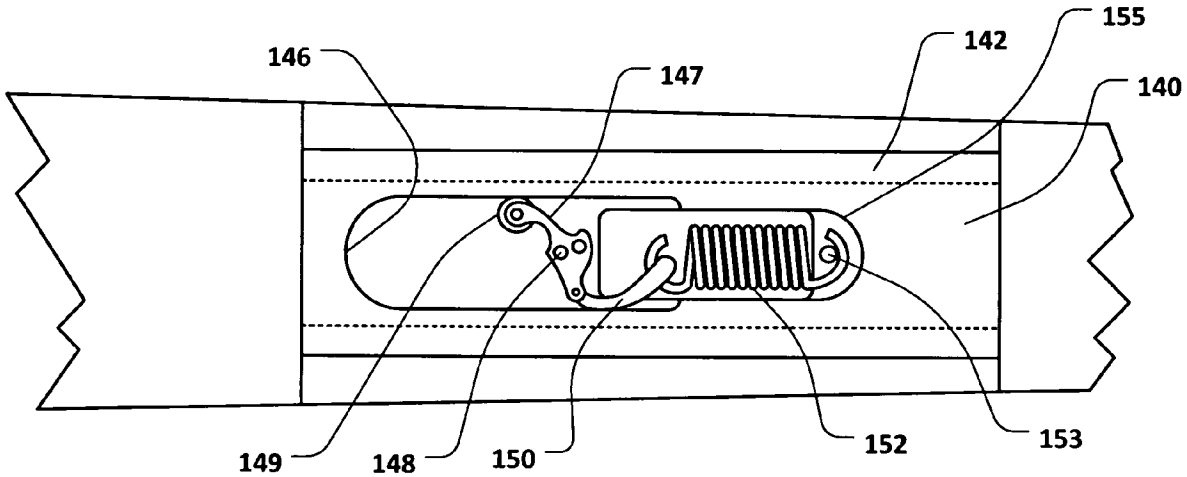
FIG. 21 shows a partial bottom plan view of FIG. 20.
Figure 24:
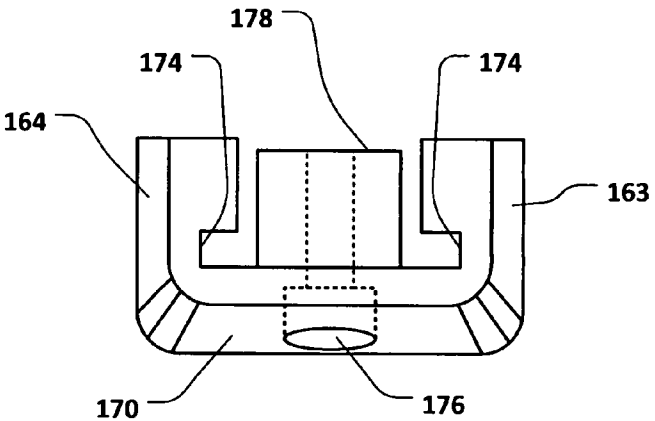
FIG. 24 shows a front elevation view of the cover member.
Figure 22:
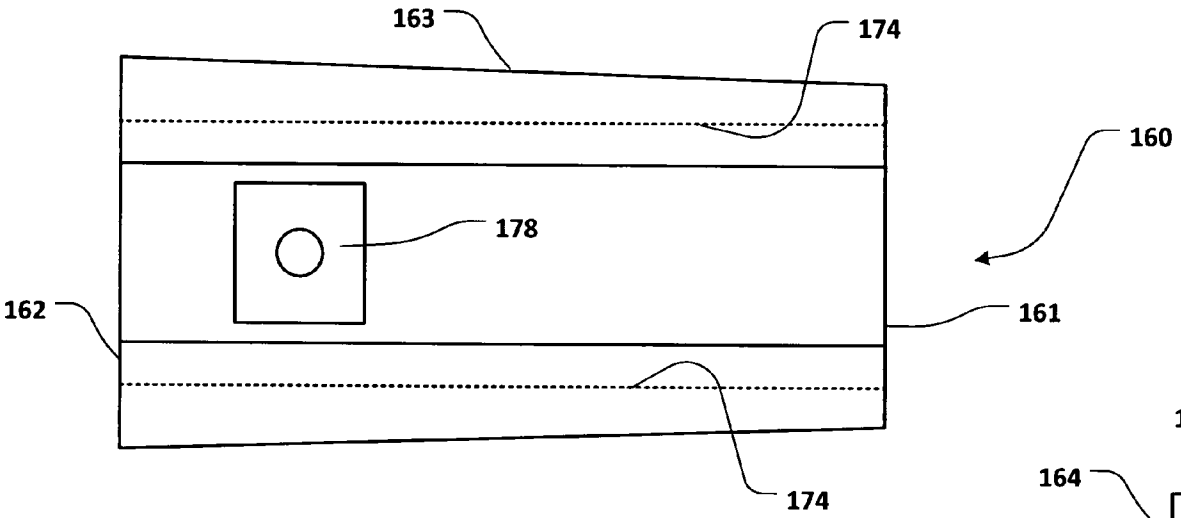
FIG. 22 shows a top plan view of the cover member.
Figure 23:
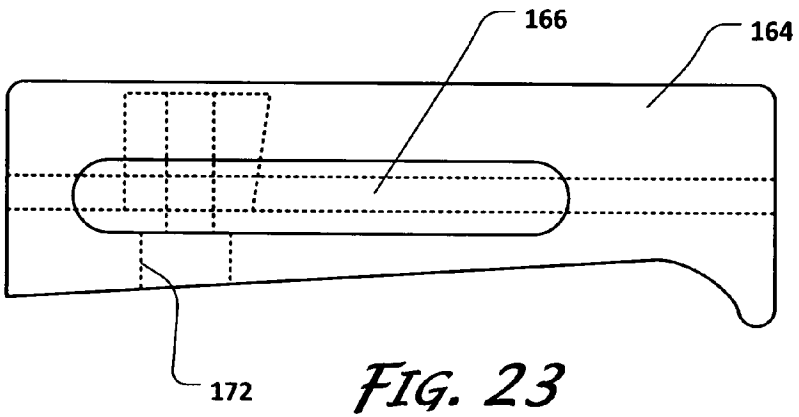
FIG. 23 shows a side elevation of the cover member.

As shown in FIG. 22, a cover member 160 has a front end 161, a rear end 162, a left side wall 163, and a right side wall 164. Finger grips 166 (as shown in FIG. 23) are formed in both of the side walls 163 and 164. Cover member 160 has a bottom wall 170 (as shown in FIG. 23) having a bore hole 172 therein. Tracks 174 are formed on the inner side wall surfaces and they telescopically receive rails 142 (as shown in FIG. 21). A screw 176 (as shown in FIG. 24) extends upwardly through bore hole 172 (as shown in FIG. 23) and is threaded into the bottom end of a tapered nut 178. Once cover 160 is slid onto rails 142, screw 176 is tightened which causes tapered nut 178 to push upwardly until it contacts cam roller 149 (as shown in FIG. 21) and preloads spring 152. The length of cover member 160 is about 1 inch short of the length of primary recess 132. When the rifle is fired, long gun stock 128 will travel rearwardly while cover member 160 is held stationary by the forward hand of the person holding the rifle. Cam roller 149 will contact tapered nut 178 causing the camming member 147 to pivot forwardly causing spring 152 to be stretched thereby reducing the recoil force.

Figure 26:
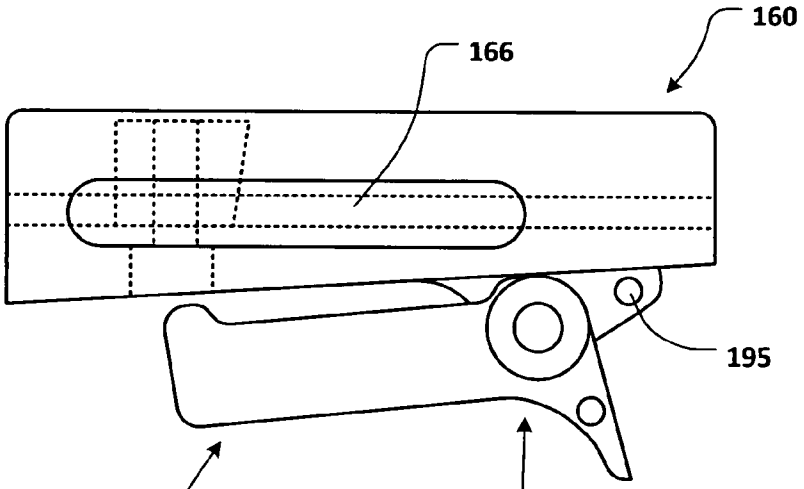
FIG. 26 shows a side elevation view of the alternative cover member showing the handgrip member in its retracted position.
Figure 25:
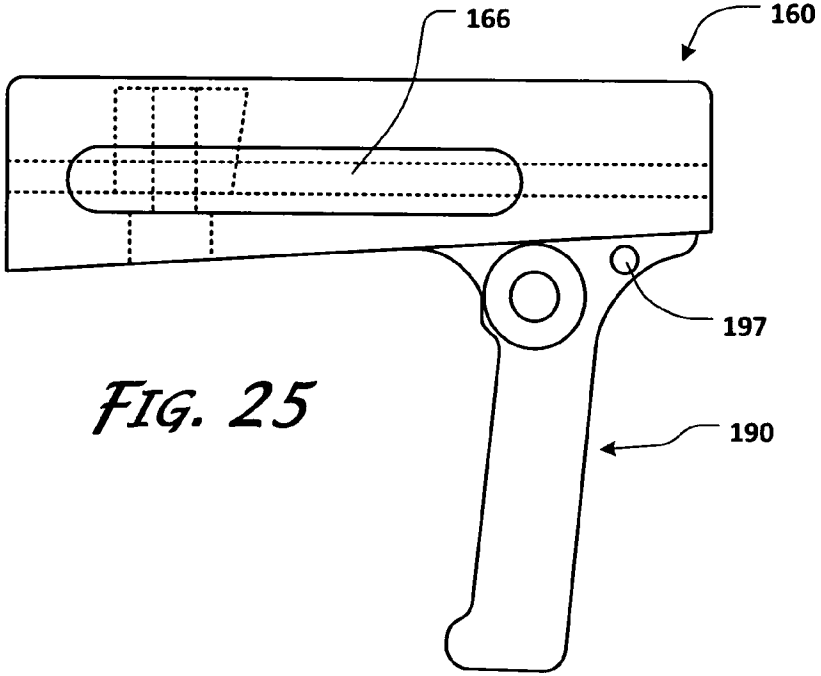
FIG. 25 shows a side elevation view of an alternative embodiment of the cover member having a retractable handgrip member secured to its bottom surface.

In FIGS. 25 and 26, cover member 160 is illustrated as having a handgrip member 190 with its top end pivotally secured to hinge assembly 192. Handgrip member 190 rotates around pivot pin 196 to its retracted position. When handgrip member 190 is in its down position, bore holes 194 and 195 align to receive a locking pin 197.

Figure 27:
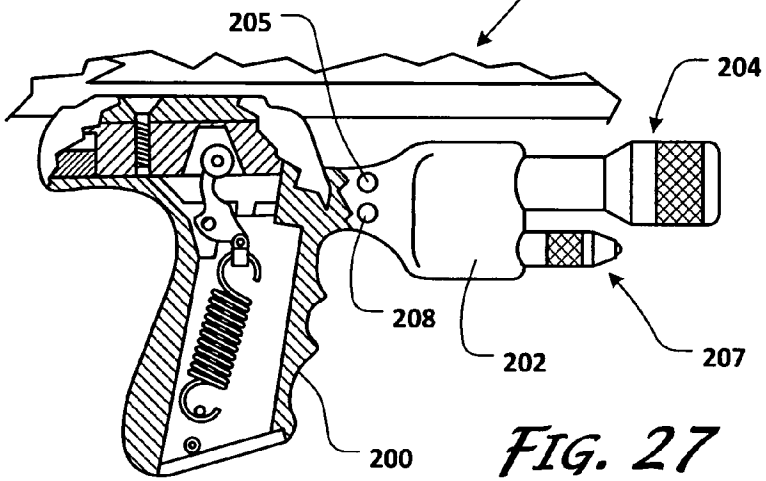
FIG. 27 shows a side elevation view illustrating a flashlight and a laser light mounted on the front end of a handgrip member.

FIG. 27 shows a side elevation view illustrating a flashlight and a laser light mounted on the front end of a handgrip member.

Figure 28:
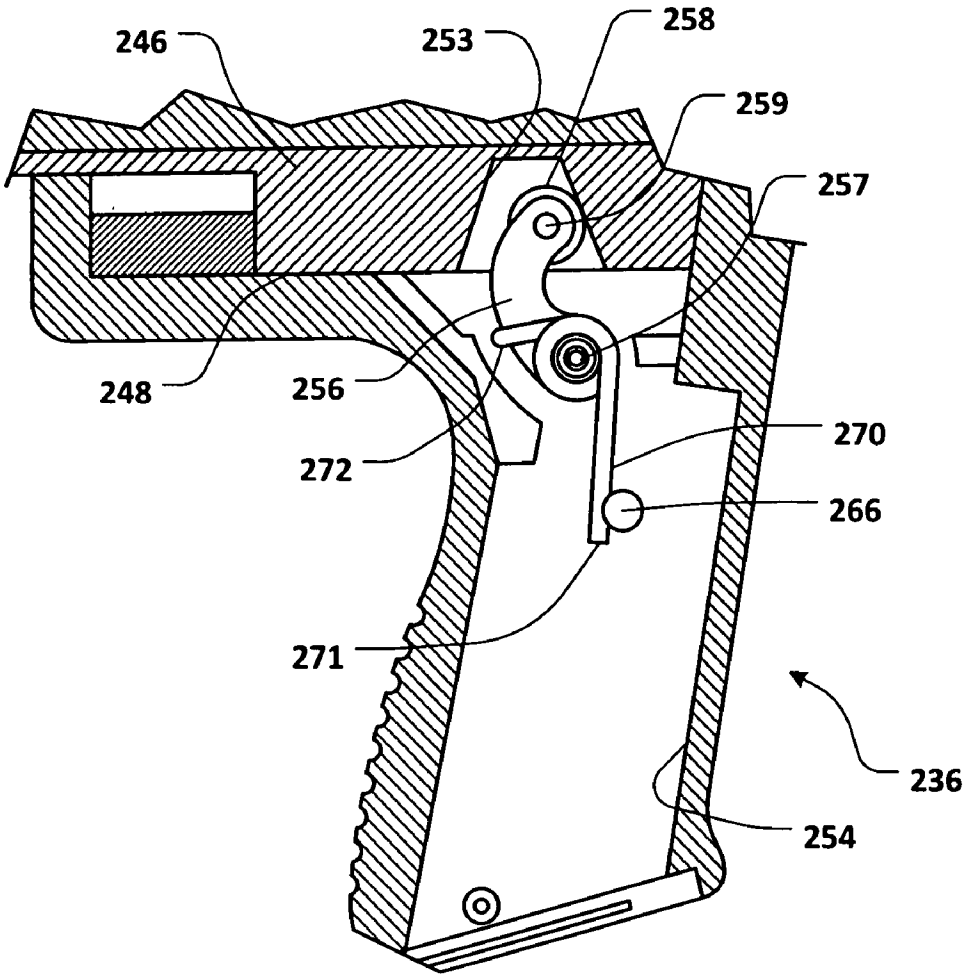
FIG. 28 shows a vertical cross section view illustrating a fifth embodiment of the recoil reduction system mounted in the handgrip member.

FIG. 28 shows a cut away side view illustrating one embodiment of a recoil reduction system comprising a recoil reduction means connected to a handgrip member 236. The recoil reduction means shown in FIG. 28 comprises a cam 256 pivotally mounted in a chamber 254 of the handgrip member 236 by a pivot pin 257. The handgrip member 236 may further comprise a track 248 formed in the top end of the handgrip member 236 and a rail 246 slidably connected to the track 248.

Figure 30A:
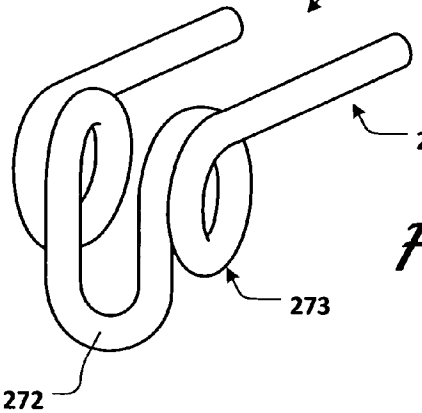
FIGS. 30A-30D show various views of an exemplary torsion spring for optional use with the recoil reduction system of this invention.
Figure 30B:
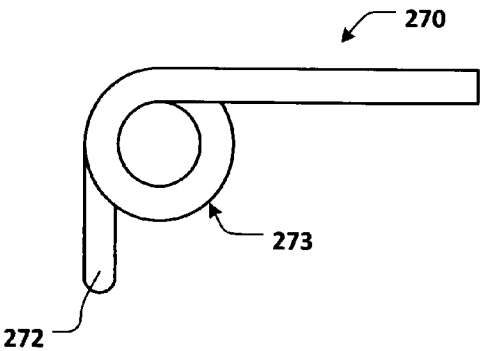
Figure 30C:
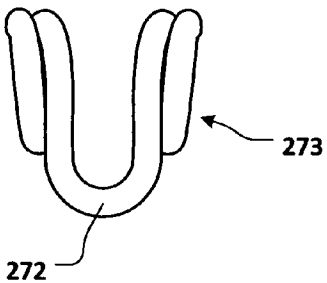
Figure 30D:
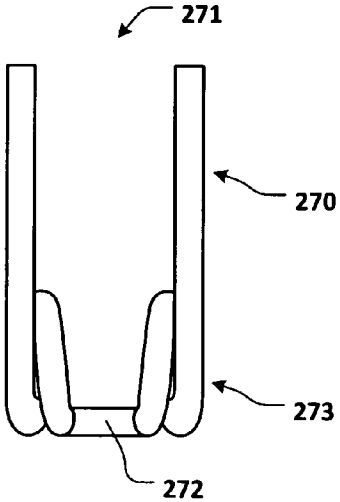
Figure 31:
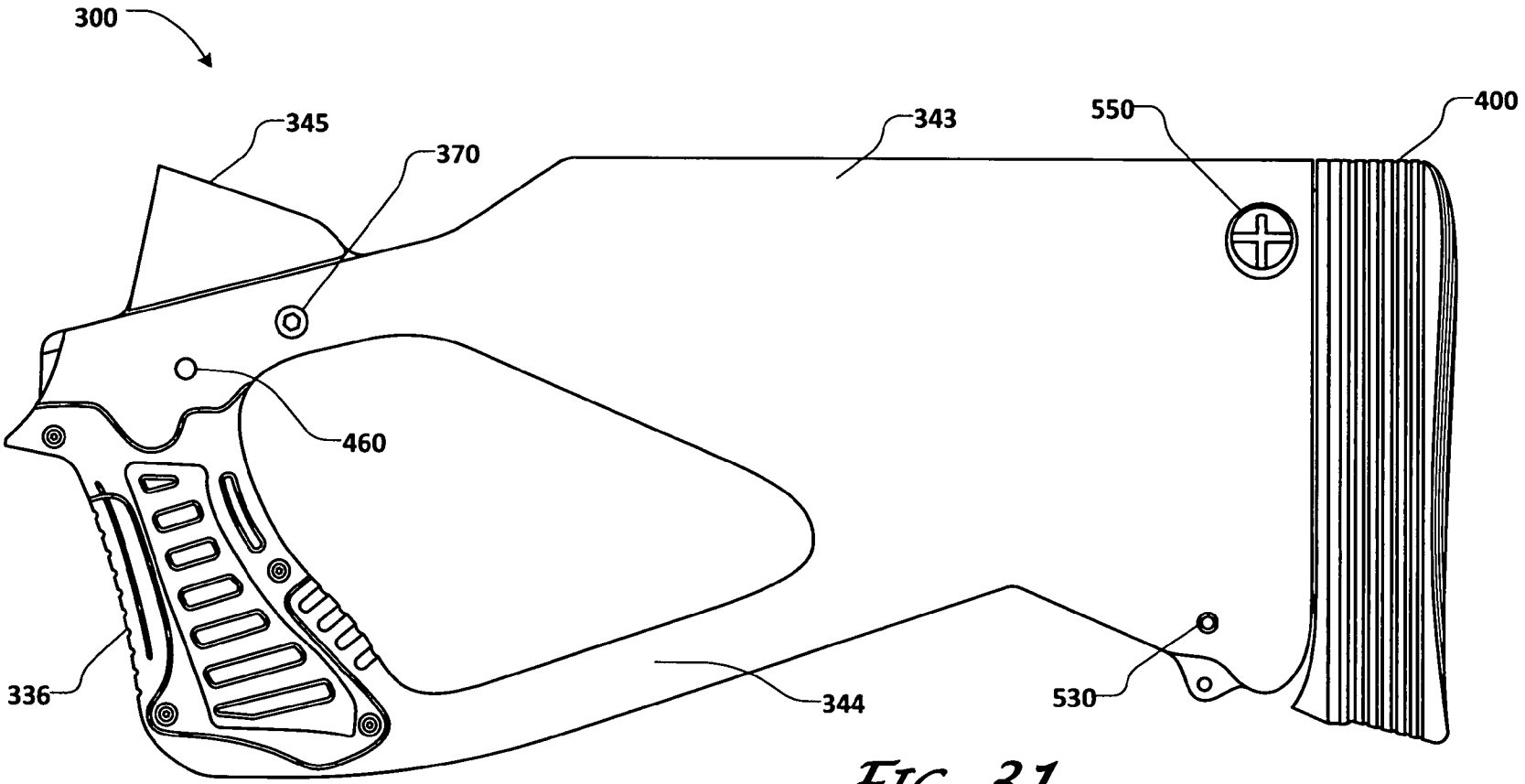
FIG. 31 shows a left side elevation view of an exemplary embodiment of a stock having a recoil reduction system according to this invention.
Figure 32:
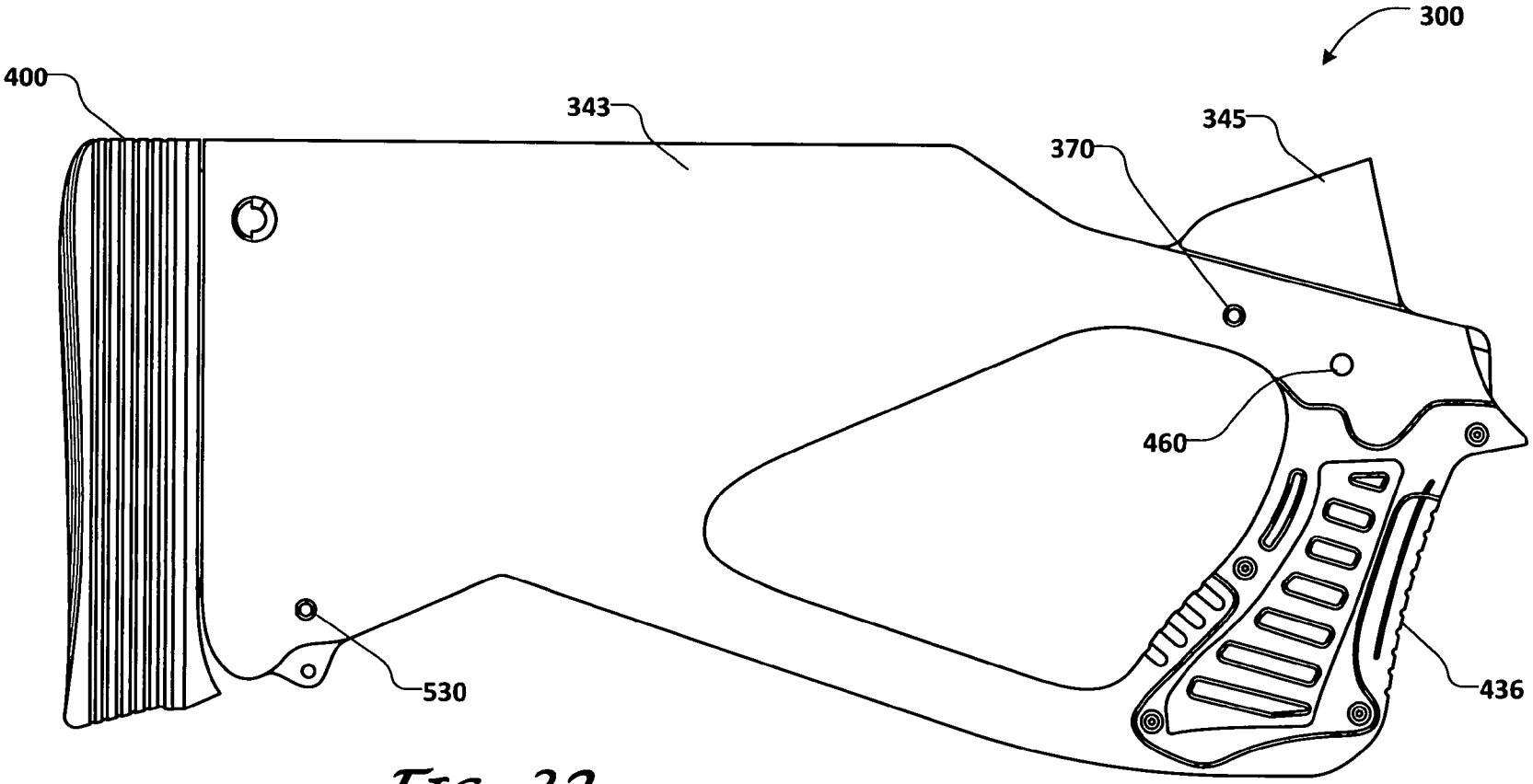
FIG. 32 shows a right side elevation view of an exemplary embodiment of a stock having a recoil reduction system according to this invention.
Figure 33:
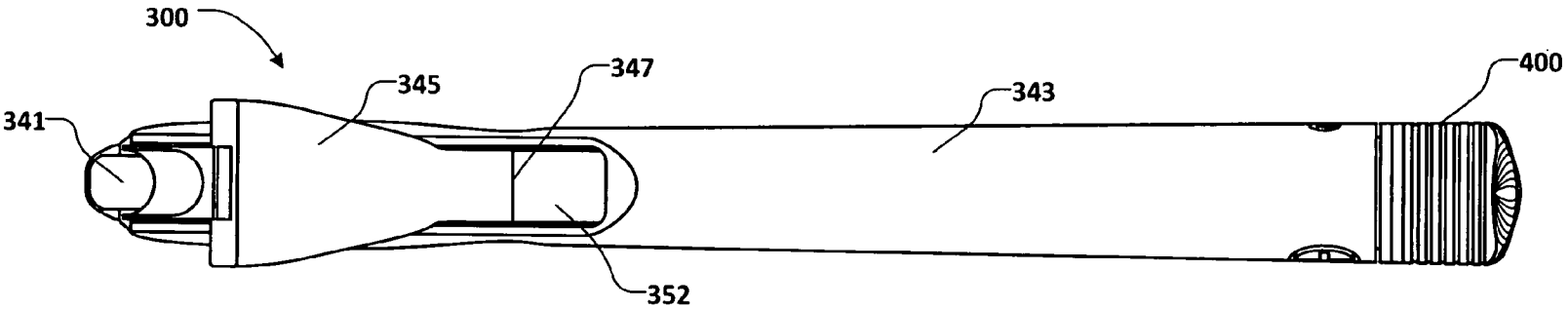
FIG. 33 shows a top plan view of an exemplary embodiment of a stock having a recoil reduction system according to this invention.
Figure 34:
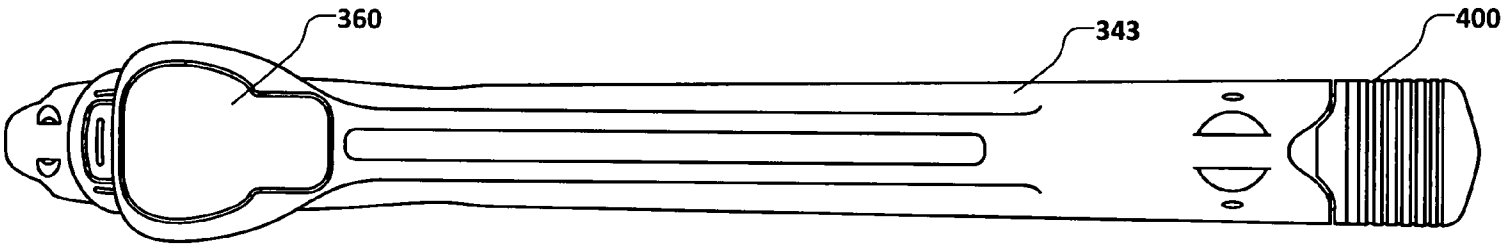
FIG. 34 shows a bottom plan view of an exemplary embodiment of a stock having a recoil reduction system according to this invention.
Figure 36:
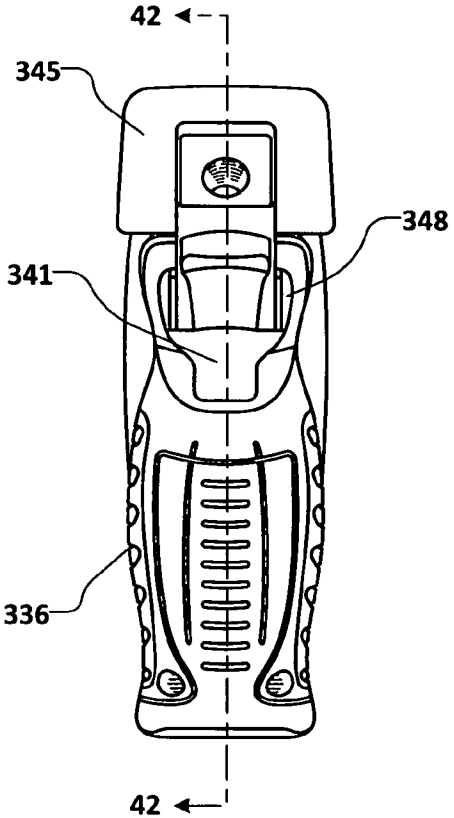
FIG. 36 shows a front elevation view of an exemplary embodiment of a stock having a recoil reduction system according to this invention.
Figure 35:
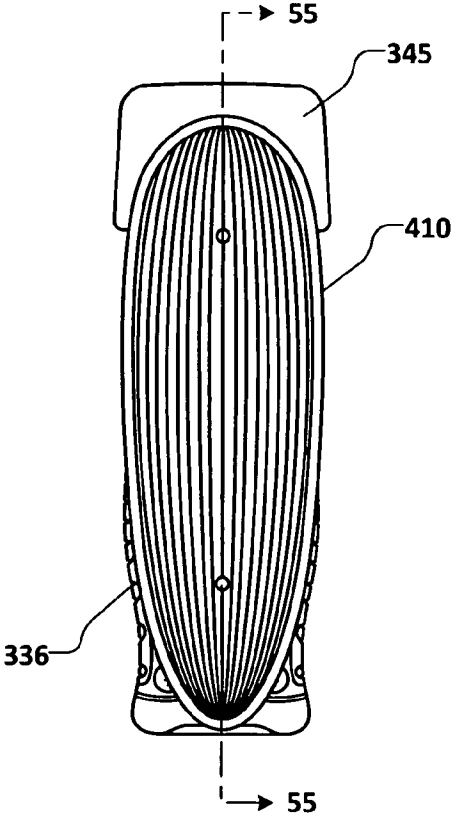
FIG. 35 shows a rear elevation view of an exemplary embodiment of a stock having a recoil reduction system according to this invention.
Figure 38:
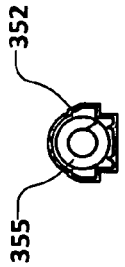
FIG. 38 shows a front elevation view of an exemplary embodiment of a compression spring within a compression spring sleeve according to this invention.

The recoil reduction means illustrated by FIG. 28 further comprises a torsion spring 270. As shown in FIGS. 30A-30D, the torsion spring 270 may have an open end 271 and a closed end 272. The torsion spring 270 may be formed from a single rod of material, which may be shaped into two coils 273, with a U-shaped joint in between creating the closed end 272. The coils 273 may be positioned such that the open centers of the coils 273 are parallel to and aligned with each other, as shown in FIGS. 30B, 30C, and 30D. Other torsion spring configurations, such as a single coil torsion spring, would be apparent to one of ordinary skill in the art, given the benefit of this disclosure.

Referring again to FIG. 28, the torsion spring 270 may be connected to the cam 256 by the pivot pin 257 and the closed end 272 of the torsion spring 270, which may be in contact with and captured by a portion of the cam 256. The open end 271 (as best shown in FIG. 30A) of the torsion spring 270 may be captured by a rigid pin 266. In this configuration, the torsion spring may move in the same arc as the cam 256, eliminating or reducing the rebound inherent in systems with traditional spring systems. For example, because the torsion spring 270 pivots about the same axis as the cam 256, all of the recoil energy that is stored in the torsion spring 270 can be used to move a connected firearm back into its pre-discharge position. Conversely, a traditional spring system may oscillate during and after a discharge, changing the direction of the recoil energy rather than absorbing it.

This oscillation may introduce another unwanted movement into the firearm, necessitating the use of a dampening means to absorb the energy stored in the spring system, increasing the cost and complexity of the system.

Figure 29:
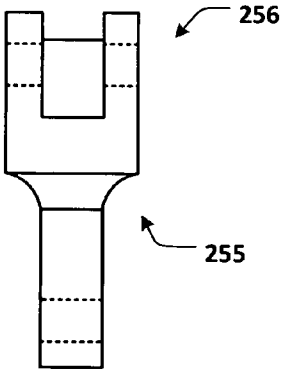
FIG. 29 shows a front elevation view illustrating the cam illustrated in FIG. 28.

In certain exemplary embodiments, the cam 256 may be shaped to better conform to the torsion spring 270, as shown in FIG. 29. For example, the cam 256 may include a profile 255 adapted to engage the torsion spring. Other cam configurations, such as non-conformal cams, would be apparent to one of ordinary skill in the art, given the benefit of this disclosure.

The recoil reducing structure may further comprise a cam roller 258 connected to the top end of the cam 256 by pin 259. The top end of the cam 256 may be positioned such that the cam roller 258 is substantially within a cavity 253, formed within the rail 246. The cam roller 258 may contact a wall of the cavity 253, which may pre-stress the torsion spring 270.

The recoil reduction system is configured to oppose rearward travel of the rail 246. For example, when connected to a firearm, the recoil from the firearm, when discharged, may apply a rearward force to the rail 246, causing it to move. Rearward movement of the rail 246 may apply force to the cam roller 258 and thus to the connected cam 256 which will pivot at the pivot pin 257. This movement will stress the torsion spring 270, which advantageously moves in the same arc as the cam 256. As the torsion spring 270 is twisted by the cam 256, the load on the torsion spring 270 increases. This loading of the torsion spring 270 creates a greater resistance to further twisting of the torsion spring 270 and movement of the cam 256, thus reducing the recoil.

As previously discussed, the torsion spring 270 can move in the same arc as the cam 256, therefore the torsion spring 270 can also move within the same space as the cam 256, and may be configured to overlap the cam 256, creating a compact assembly with respect to traditional spring recoil systems. A compact torsion spring 270 and cam 256 assembly may be used advantageously in smaller areas than traditional spring systems and may have fewer moving parts. For example, an elongated forend may have limited space for a recoil reduction system, requiring such systems to be generally flat and run the length of the forend.

Prior recoil system adapted for elongated forends have required a number additional moving parts to accommodate the size and shape of the space available within the forend. One example is the embodiment described above and shown in FIG. 17, which requires the extra retainer member 113.

FIGS. 31-50 show various views of an exemplary embodiment of a recoil reduction system 300 and certain components for the recoil reduction system 300, according to this invention. As shown in FIGS. 31-50, the recoil reduction system 300 may include two recoil reduction means, the first recoil reduction means being a camming lever that interacts with a sliding member and the second recoil reduction means being a compression spring that interacts with a sliding member.

In various exemplary embodiments, the recoil system 300 includes at least some of a sliding member 345 and a stock 343. The stock 343 includes a handgrip member 336. As shown in FIGS. 31-43, the recoil reduction system 300 is included within an exemplary stock 343 that can be detachably secured, via a sliding member 345, to the rear end of a receiver of a rifle, shotgun, or other similar firearm or weapon. A mating structure or mounting means of the sliding member 345 is formed so as to mate with a corresponding structure at the rear end of the firearm receiver.

In various exemplary, nonlimiting embodiments, the stock 343 comprises a thumbhole style stock having a handgrip member 336 and a buttplate assembly 400. The buttplate assembly 400 is attached to the stock 343 via an attachment pin 530 and a buttplate engaging lever 550. It should be appreciated to that the bridging member 344 of the stock 343 is optional. Therefore, the stock 343 may include the bridging member 344 and be considered a thumbhole style stock. Alternatively, the stock 343 may be formed without the bridging member 344, in which case the stock 343 would be considered a pistol grip style stock, and not a thumbhole style stock.

In various exemplary embodiments, the stock 343 includes a cavity 344 formed within at least a portion of the stock 343.

Figure 37:
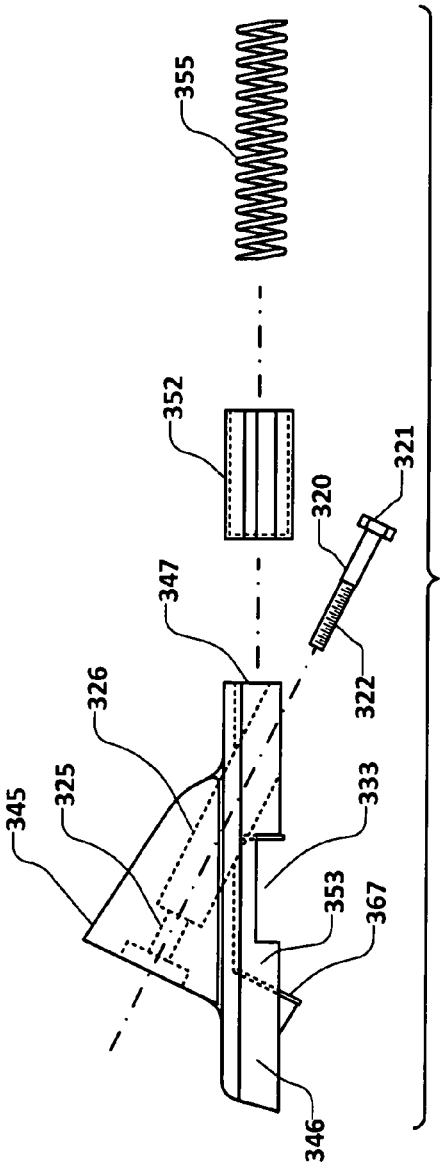
FIG. 37 shows a left side elevation view of certain of the constituent components of a recoil reduction system according to this invention.
Figure 41:
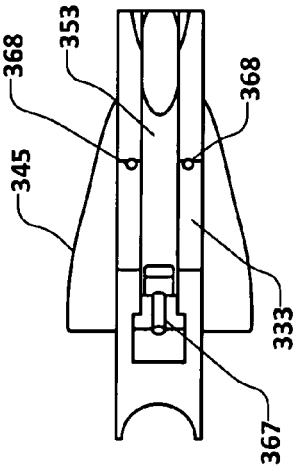
FIG. 41 shows a bottom plan view of an exemplary embodiment of a sliding member according to this invention.
Figure 40:
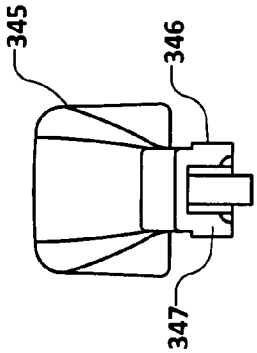
FIG. 40 shows a rear elevation view of an exemplary embodiment of a sliding member according to this invention.
Figure 39:
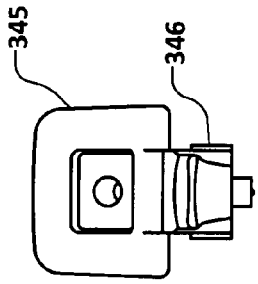
FIG. 39 shows a front elevation view of an exemplary embodiment of a sliding member according to this invention.
Figure 42:
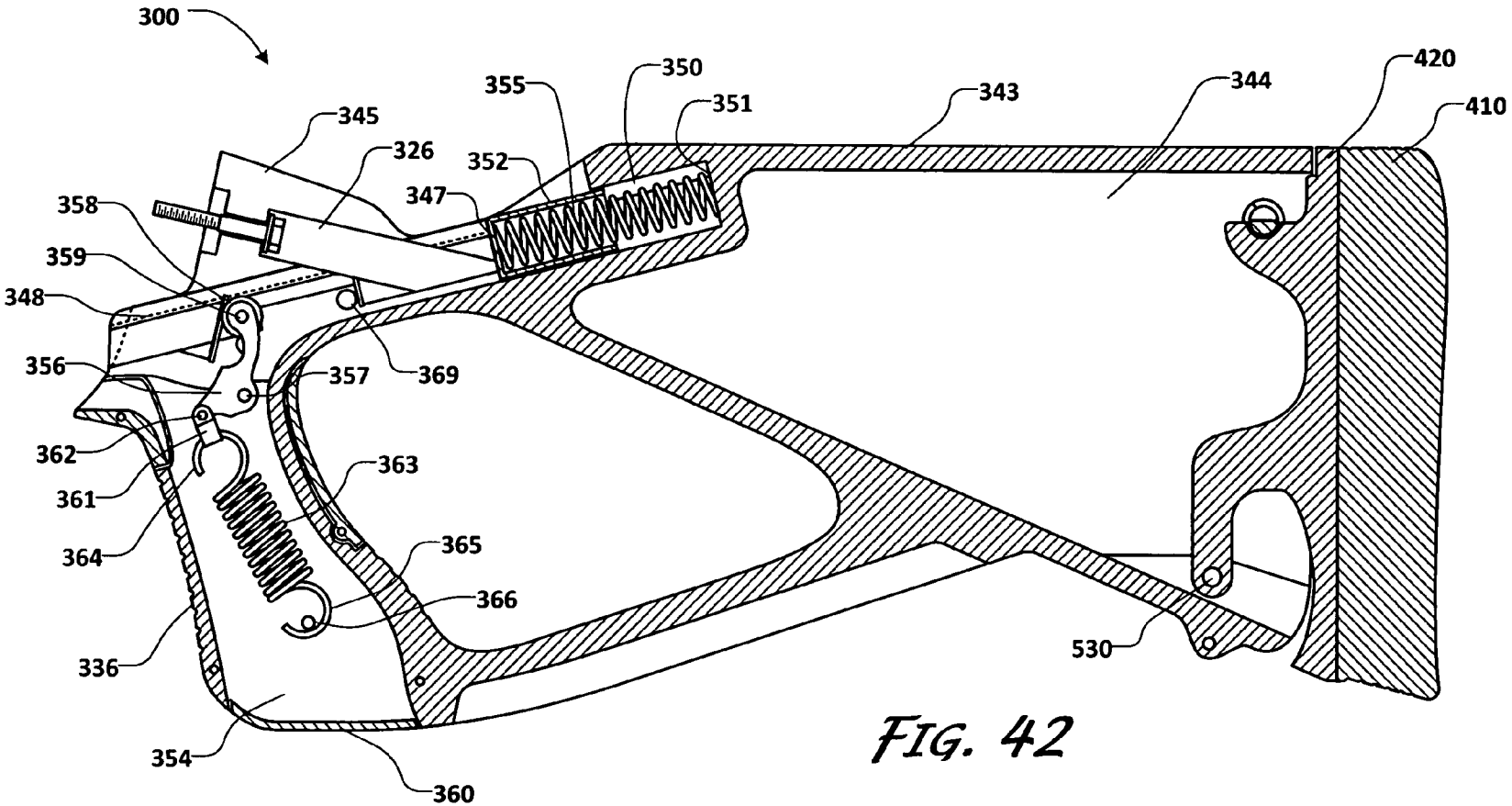
FIG. 42 shows a left side cross-sectional view, taken along line 42-42 of FIG. 36, of an exemplary embodiment of a stock having a recoil reduction system according to this invention, wherein the sliding member is in the forward, static position.

As illustrated most clearly in FIG. 37, the sliding member 345 has a front wall, a rear wall 347, a top wall, a bottom wall, a left side wall, and a right side wall. An inverted T-shaped rail or slide 346 is formed along the side walls of the sliding member 345. A bore hole 325 extends through sliding member 345 and is formed so as to receive a bolt 320 having a head 321 and a threaded portion 322. A countersunk hole 326 provides a receptacle for the head 321 of the bolt 320. Threaded portion 322 is formed so as to be threaded into a conventional structure in the rear end of the firearm receiver.

A cam roller cavity 353 is formed in the bottom surface of the rail 346. In various exemplary embodiments, the cam roller cavity 353 includes a ramped wall that is formed so as to be engaged by a cam roller 358. In various exemplary embodiments, the cam roller cavity 353 includes a hardened pin 367 that is placed atop the ramped wall surface or embedded at least partially within the ramped wall surface, such that the cam roller 358 engages the hardened pin 367.

A stop pin cavity 333 is also formed in the bottom surface of the rail 346. The stop pin cavity 333 is formed so as to allow a sliding member stop pin 370 to traverse the cavity 333, when positioned within the stop pin retaining aperture 369, and retain the sliding member 345 within the stock 343. In various exemplary embodiments, a rear wall of the stop pin cavity 333 is contacted directly by the stop pin 370. Alternatively, the stop pin cavity 333 includes hardened pins 368 that are placed atop the stop pin cavity wall surface or are embedded at least partially within the stop pin cavity wall surface, such that the stop pin 370 engages the hardened pins 368.

Handgrip member 336 has a front wall and a rear wall. A chamber 354 is formed within the handgrip member 336. In certain exemplary embodiments, the chamber 354 extends from a bottom end of the handgrip member 336 to a top end of the handgrip member 336. Alternatively, the chamber 354 may only extend from the top end of the handgrip member 336 downward into, but not through, the handgrip member 336. The chamber 354 extends upwardly through the handgrip member 336. In various exemplary embodiments, a bottom cover 360 is formed so as to be removably or permanently affixed to the bottom end of handgrip member 336 to cover the bottom of the chamber 354

A recess 341 is formed in front wall adjacent its top end so that a trigger guard of an attached firearm can travel rearwardly as a unitary structure with sliding member 345 when the firearm is fired.

A camming member 356 (as illustrated most clearly in FIGS. 45A and 45B) is pivotally mounted in the chamber 354 by a pivot pin 357. The camming member 356 includes a pair of upper bi-furcated arms that have a cam roller 358 secured thereto by a pin 359. A retainer 361 is rotatably secure to the bottom end of the camming member 356 by a pin 362. A coil spring 363 has an upper hook portion 364 captured in the retainer 361. A rigid pin 366 is secured within the chamber 354 and a lower hook portion 365 of the coil spring 363 is captured by the rigid pin 366.

The stock 343 includes an inverted T-shaped groove or track 348 in which the inverted T-shaped rail 346 of the sliding member 345 is able to travel axially. When the T-shaped rail 346 is placed within the T-shaped track 348 and the sliding member stop pin 370 is in place, the cam roller 358 is captured and travels in the cam roller cavity 353 formed in the bottom surface of inverted T-shaped rail 346 and the sliding member stop pin 370 interacts with the stop pin cavity 333 so as to limit the travel of the sliding member 345 relative to the stock 343.

A recess or cavity 350 is also formed in the stock 343, directly behind and in cooperating relationship with the T-shaped track 348. The cavity 350 extends to a bottom wall 351. In certain exemplary embodiments, the cavity 350 is merely an extension of the T-shaped track 348.

In various exemplary embodiments, the cavity 350 is formed such that a compression spring 355 may be positioned within the cavity 350 such that a front end of the compression spring 355 is positioned against the rear wall 347 of the sliding member 345 and a rear end of the compression spring 355 is positioned against the bottom wall 351 of the cavity 350. Alternatively, the compression spring 355 may be housed at least partially within a compression spring sleeve 352. The compression spring sleeve 352 has an outer profile similar to an outer profile of at least a portion of the T-shaped rail 346 of the sliding member 345, such that the compression spring sleeve 352 is able to slide within the cavity 350.

When the compression spring sleeve 352 is utilized, the rear end of the compression spring 355 is positioned against the bottom wall 351 of the cavity 350 and the front end of the compression spring 355 is positioned within a cavity of the compression spring sleeve 352. A front end of the compression spring sleeve 352 is positioned against the rear wall 347 of the sliding member 345.

When the firearm (including the stock 343 and an attached firearm receiver) is fired, the firearm receiver and sliding member 345 travel rearwardly, as a unitary structure. The rearward travel of sliding member 345 forces the cam roller 358 rearward as the cavity 353 moves rearward. This rearward travel of the cam roller 358 causes camming member 356 to pivot rearward, causing the coil spring 363 to be stretched upward. This absorbs most of the recoil of the firearm, thereby dampening the firearm recoil. When the recoil force subsides, the natural retracting force of the coil spring 363 causes camming member 356 to rotate forward and return sliding member 345 to its forward, static position.

Figure 43:
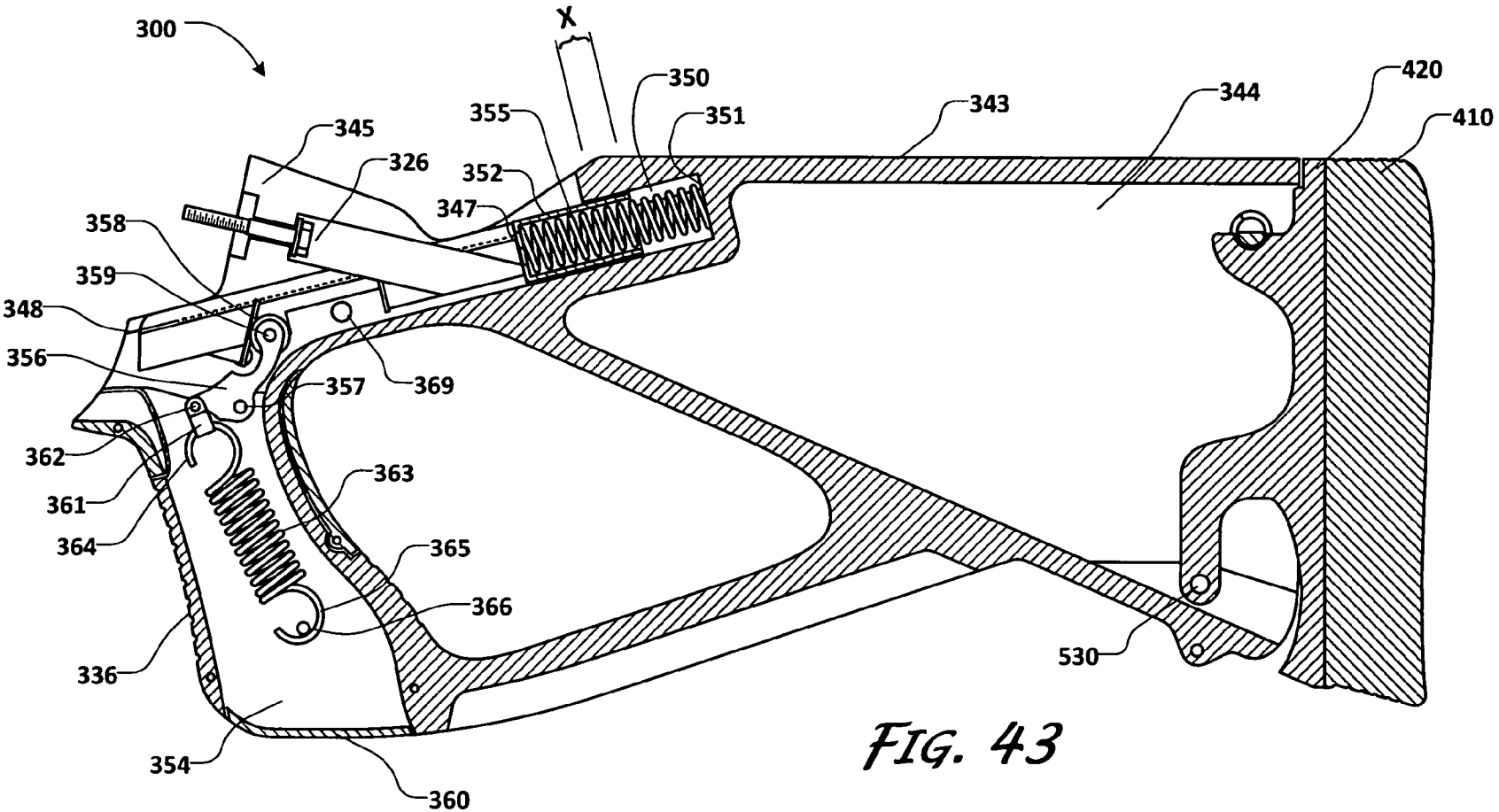
FIG. 43 shows a left side cross-sectional view of an exemplary embodiment of a stock having a recoil reduction system according to this invention, wherein the sliding member is in the rearward, recoil reduction position.
Figure 46A:
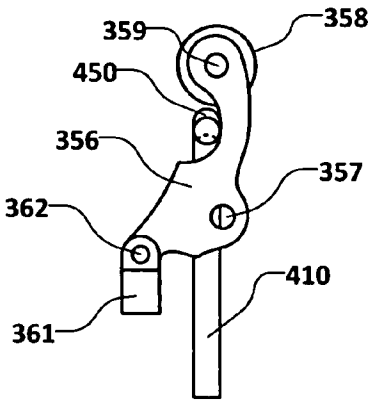
FIGS. 46A and 46B show a an exemplary disassembly tool being used to rotate an exemplary cam according to this invention.
Figure 46B:
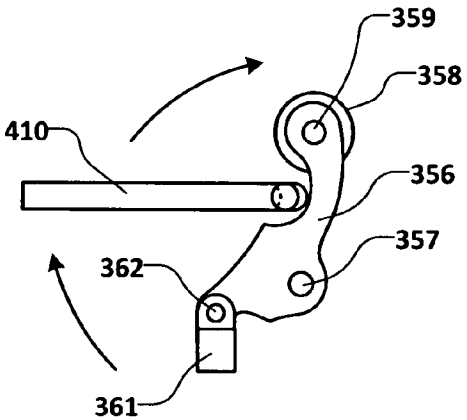
Figure 45A:
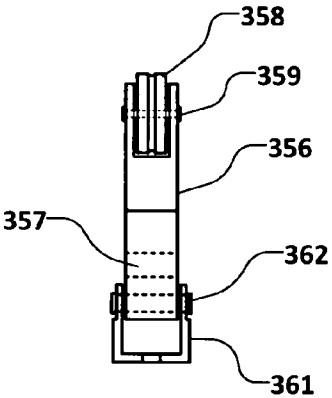
FIG. 45A shows a front elevation view of an exemplary embodiment of a camming member and retainer for use with the recoil reduction system according to this invention.
Figure 45B:
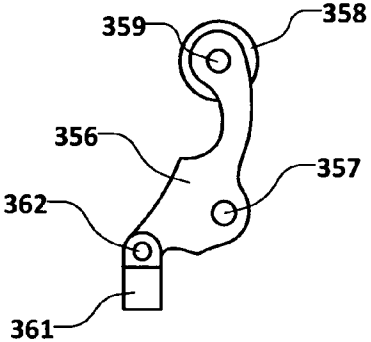
FIG. 45B shows a left side elevation view of an exemplary embodiment of a camming member and retainer for use with the recoil reduction system according to this invention.
Figure 44A:
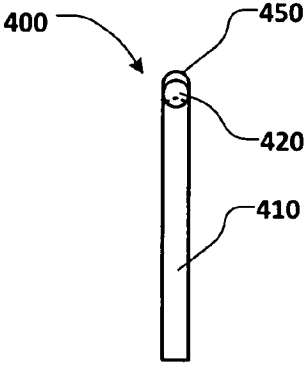
FIG. 44A shows a front elevation view of an exemplary embodiment of a disassembly tool for use with the recoil reduction system according to this invention.
Figure 44B:
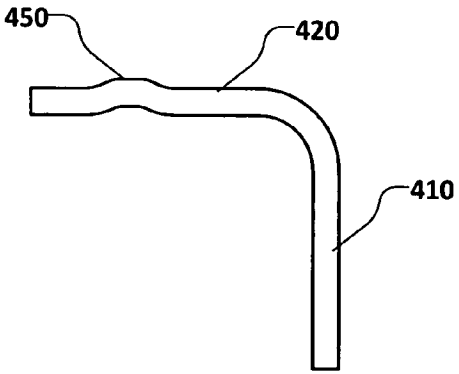
FIG. 44B shows a left side elevation view of an exemplary embodiment of a disassembly tool for use with the recoil reduction system according to this invention.

During a recoil cycle, the sliding member 345 typically travels a distance X, as illustrated viewing FIG. 43, with respect to the stock 343. In certain exemplary embodiments, the distance X may optionally be in the range of ¾ of an inch to 1 inch. However, it should be appreciated that the distance X can be modified based on a number of factors, including the characteristics of the coil spring 363, the compression spring 355, and the profile of the camming member 356, the angle of the wall of the cam roller cavity 353, the length of the stop pin cavity 333, and the like.

FIGS. 44A, 44B, 46A, and 46B show an exemplary embodiment of a disassembly tool 400 for use with the recoil reduction system 300 of this invention and the interaction of the disassembly tool 400 and a camming member 356. As illustrated in FIGS. 44A, 44B, 46A, and 46B, the disassembly tool 400 comprises a body having a handle portion 410 and a key portion 420. In various exemplary embodiments, the disassembly tool 400 is formed of a sufficiently rigid, circular portion of material.

As illustrated, the handle portion 410 is positioned approximately 90° relative to the key portion 420. It should be appreciated that the relative positions of the handle portion 410 and the key portion 420 are a design choice based upon the desired appearance and mechanical advantage desired.

The key portion 420 is formed such that the key portion can be received within the disassembly aperture 460 of the stock 343. A bump or protrusion 450 is formed in the key portion 420.

When a key portion 420 is inserted within the disassembly aperture 460 of the stock 343, the protrusion 450 is positioned to contact an upper portion of the camming member 356, when the disassembly tool 400 is rotated.

When the disassembly tool 400 is rotated, the protrusion 450 contacts the camming member 356 and, so long as the amount of torque applied to the handle portion 410 of the disassembly tool 400 is sufficient to overcome the spring bias of the coil spring 363, the camming member 356 is forced rearward.

When the camming member 356 is forced rearward, a force can be applied to the sliding member 345, sufficient to overcome the spring bias of the compression spring 355 and slide the sliding member 345 rearward.

When you sliding member 345 is slid rearward, the sliding member stop pin 370 can be moved from the stop pin aperture 369. When the stop pin 370 is removed, the sliding member 345 can be slid forward, and removed from the stock 343. This can be done for example, to facilitate attachment of a receiver to the sliding member 345.

It should be appreciated that to reassemble the recoil reduction system 300, the steps outlined above are merely performed in reverse.

FIGS. 47-50 show left side cross-sectional views of exemplary embodiments of recoil reduction systems mounted in a handgrip member 336 according to this invention.

Figure 47:
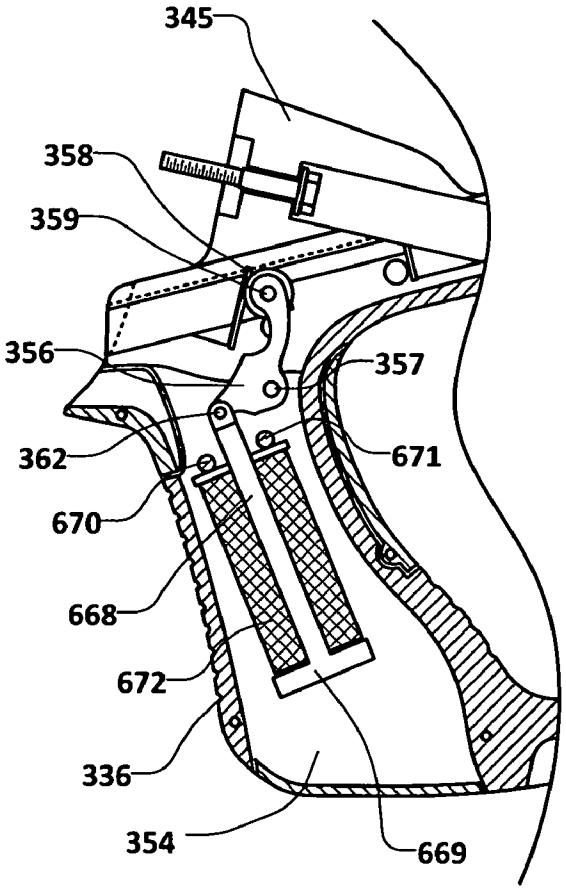

A first variation of the recoil reducing structure in the handgrip member 336 is illustrated in FIG. 47. As shown in FIG. 47, the alternative recoil structure includes a rod 668 having its bottom end connected to plate 669 and its top end is pivoted on pin 362. An elastomeric tube 672 is telescoped over rod 668 and its top end bears against pins 670 and 671. Rearward travel of the sliding member 345 will pivot camming member 356 rearwardly causing elastomeric tube 672 to be compressed and reduce recoil.

Figure 48:
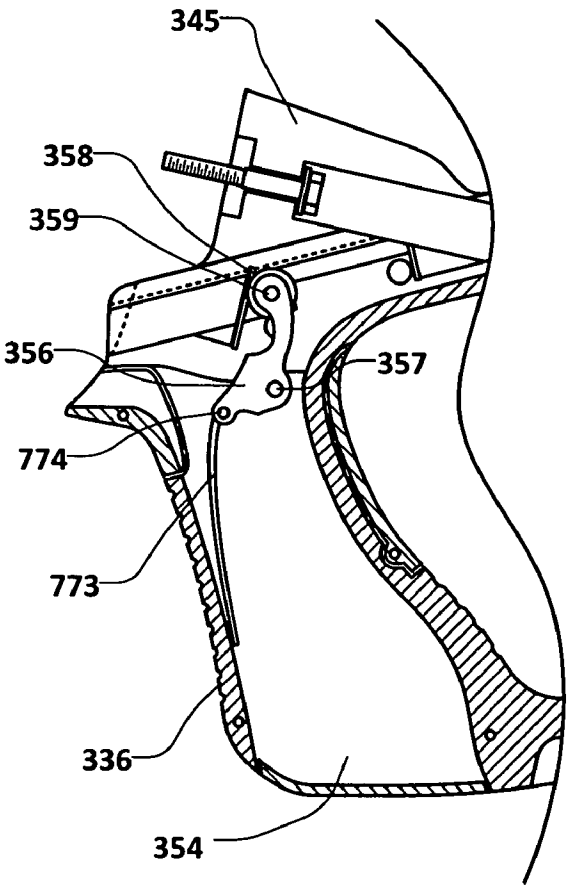
FIGS. 47-50 show left side cross-sectional views of exemplary embodiments of recoil reduction systems mounted in a handgrip member according to this invention.

A second alternative recoil reducing structure is illustrated in FIG. 48. As shown in FIG. 48, the alternative recoil structure includes a leaf spring 773 having a stressed curvature in its static state. A top end of the leaf spring 773 is captured by attachment structure 774 on the bottom end of camming member 56 and its bottom end is pressed against the inner wall of handgrip member 336. Rearward travel of the sliding member 345 will cause camming member 356 to be rotated rearwardly, causing the spring 773 to be flexed and causing recoil reduction.

Figure 49:
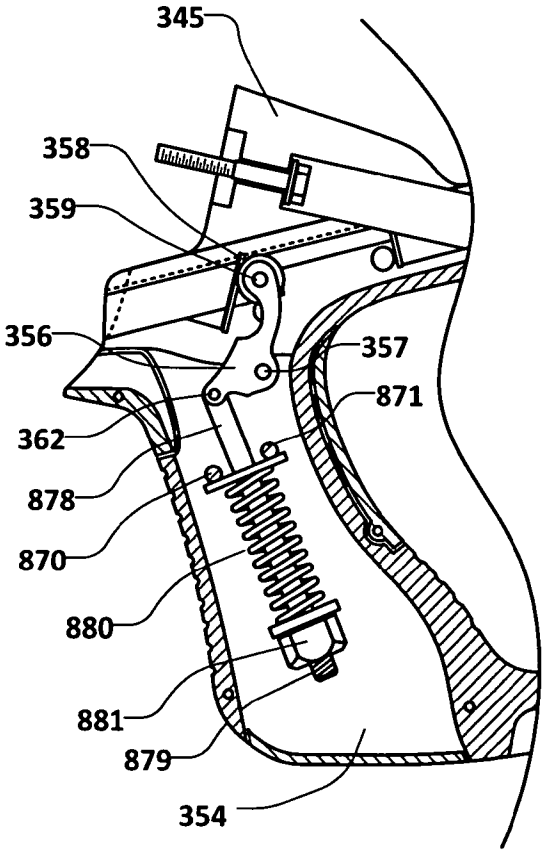
Figure 51B:
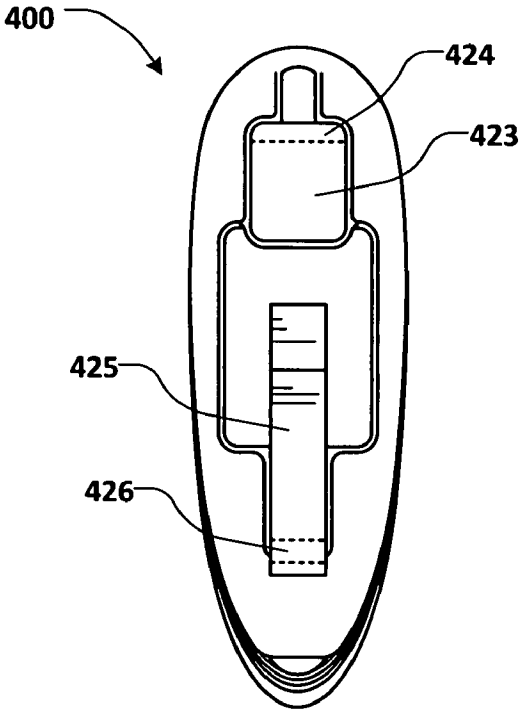
FIG. 51B shows a front elevation view of an exemplary embodiment of a buttplate assembly according to this invention.
Figure 51A:
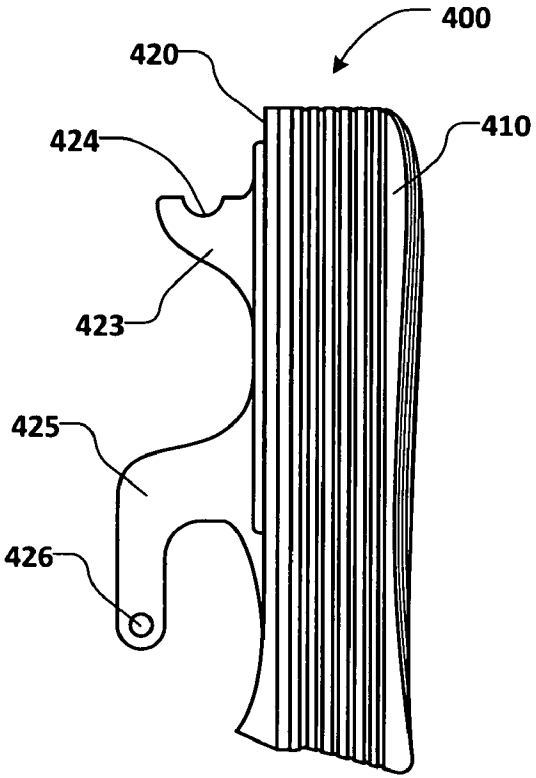
FIG. 51A shows a left side elevation view of an exemplary embodiment of a buttplate assembly according to this invention.
Figure 52B:
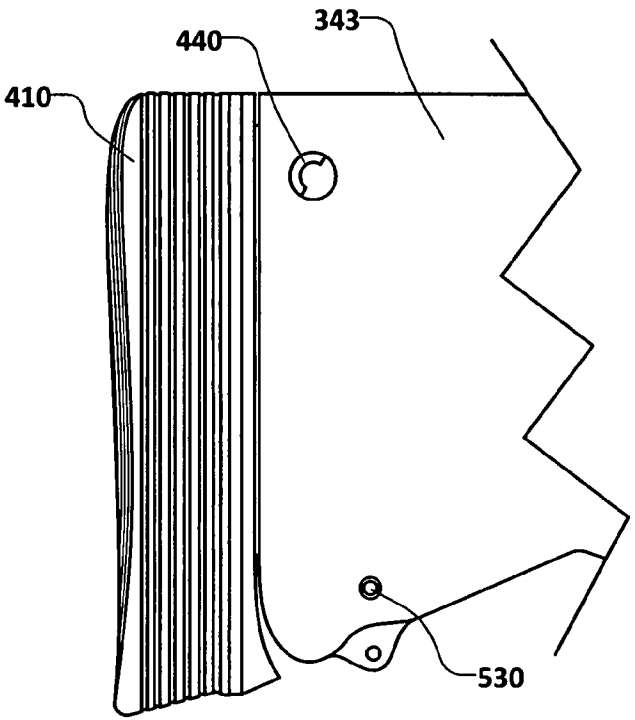
FIG. 52B shows a right side elevation view of an exemplary embodiment of a buttplate assembly according to this invention, wherein the buttplate assembly is attached to a butt stock and is in a closed position.
Figure 52A:
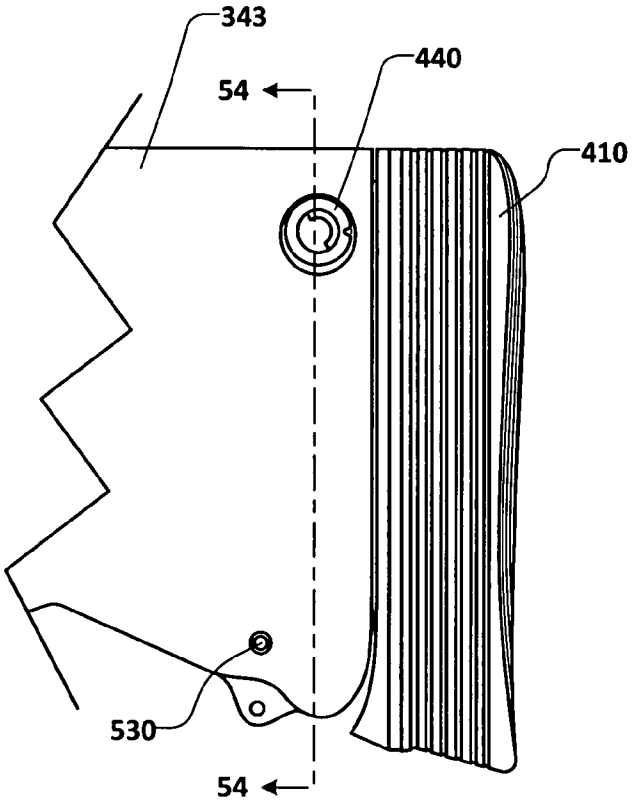
FIG. 52A shows a left side elevation view of an exemplary embodiment of a buttplate assembly according to this invention, wherein the buttplate assembly is attached to a butt stock and is in a closed position.
Figure 53A:
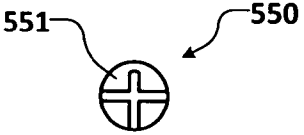
FIGS. 53A through 53D show various views of an exemplary embodiment of a buttplate engagement lever according to this invention.
Figure 53B:
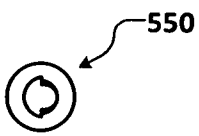
Figure 53C:
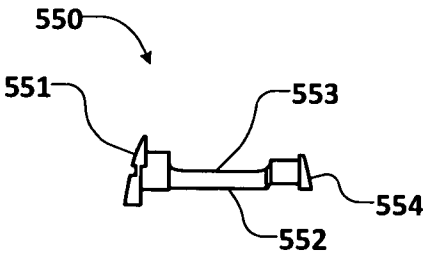
Figure 53D:
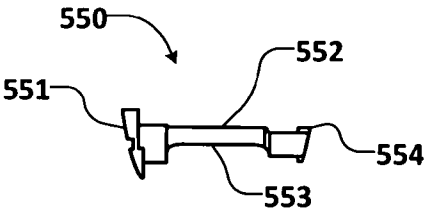

A third alternative recoil structure is illustrated in FIG. 49. As shown in FIG. 49, the alternative recoil structure includes a coil spring 880 in chamber 354. A rod 878 includes a threaded portion 879, which threadably receives a nut 881. A top end of the rod 878 includes an aperture that is captured by pin 362, such that the rod 878 is able to pivot around the pin 362. The coil spring 880 surrounds the rod 878, and is maintained in place by the nut 881. Pins 870 and 871 press against the top end of spring 880. When the sliding member 345 travels rearwardly, camming member 356 has its top end pivoted rearwardly and spring 880 is compressed, causing recoil reduction.

Figure 50:
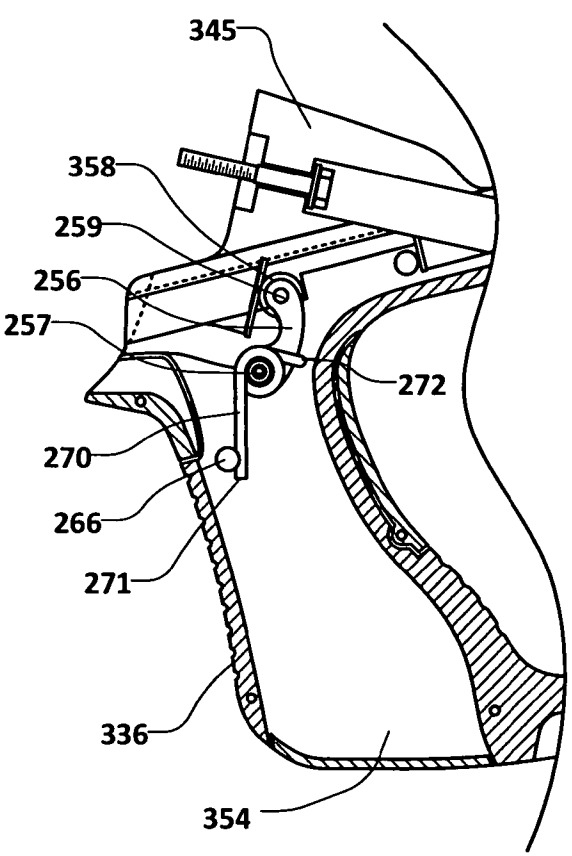

A fourth alternative recoil structure is illustrated in FIG. 50. As shown in FIG. 50, the alternative recoil structure comprises a cam 256 pivotally mounted in a chamber 354 of the handgrip member 336 by a pivot pin 257.

The recoil reduction means illustrated in FIG. 50 further comprises a torsion spring 270. As shown in FIGS. 30A-30D, the torsion spring 270 may have an open end 271 and a closed end 272. The torsion spring 270 may be formed from a single rod of material, which may be shaped into two coils 273, with a U-shaped joint in between creating the closed end 272. The coils 273 may be positioned such that the open centers of the coils 273 are parallel to and aligned with each other, as shown in FIGS. 30B, 30C, and 30D. Other torsion spring configurations, such as a single coil torsion spring, would be apparent to one of ordinary skill in the art, given the benefit of this disclosure.

Referring again to FIG. 50, the torsion spring 270 may be connected to the cam 256 by the pivot pin 257 and the closed end 272 of the torsion spring 270, which may be in contact with and captured by a portion of the cam 256. The open end 271 (as best shown in FIG. 30A) of the torsion spring 270 may be captured by a rigid pin 266. In this configuration, the torsion spring 270 may move in the same arc as the cam 256, eliminating or reducing the rebound inherent in systems with traditional spring systems. For example, because the torsion spring 270 pivots about the same axis as the cam 256, all of the recoil energy that is stored in the torsion spring 270 can be used to move a connected firearm back into its pre-discharge position. Conversely, a traditional spring system may oscillate during and after a discharge, changing the direction of the recoil energy rather than absorbing it.

This oscillation may introduce another unwanted movement into the firearm, necessitating the use of a dampening means to absorb the energy stored in the spring system, increasing the cost and complexity of the system.

The recoil reducing structure further comprises a cam roller 358 connected to the top end of the cam 256 by pin 259. The top end of the cam 256 may be positioned such that the cam roller 358 is substantially within a cam roller cavity 353, formed within the rail 346. The cam roller 358 may contact a wall of the cam roller cavity 353 or a hardened pin 367, which may pre-stress the torsion spring 270.

The recoil reduction system is configured to oppose rearward travel of the rail 346. For example, when connected to a firearm, the recoil from the firearm, when discharged, may apply a rearward force to the rail 346, causing it to move. Rearward movement of the rail 346 may apply force to the cam roller 358 and thus to the connected cam 256, which will pivot at the pivot pin 257. This movement will stress the torsion spring 270, which advantageously moves in the same arc as the cam 256. As the torsion spring 270 is twisted by the cam 256, the load on the torsion spring 270 increases. This loading of the torsion spring 270 creates a greater resistance to further twisting of the torsion spring 270 and movement of the cam 256, thus reducing the recoil.

As previously discussed, the torsion spring 270 can move in the same arc as the cam 256, therefore the torsion spring 270 can also move within the same space as the cam 256, and may be configured to overlap the cam 256, creating a compact assembly with respect to traditional spring recoil systems. A compact torsion spring 270 and cam 256 assembly may be used advantageously in smaller areas than traditional spring systems and may have fewer moving parts.

FIGS. 51A-55B show various views of an exemplary embodiment of a buttplate assembly 400 and certain components for the buttplate assembly 400 as used in connection with the stock 343 according to this invention. As illustrated in FIGS. 51A-55B, a buttplate assembly 400 comprises a pad member 410 and a base member 420. The pad member 410 typically comprises a rubber padding portion that is included to help further reduce the effects of recoil on a user shoulder. The pad member 410 is typically attached, coupled, or affixed to the base member 420.

The base member 420 includes a locking leg 423 and an attachment leg 425. The locking leg 423 protrudes from the base member 420 and includes a locking notch 424 formed in a top portion of the locking leg 423.

Figure 55B:
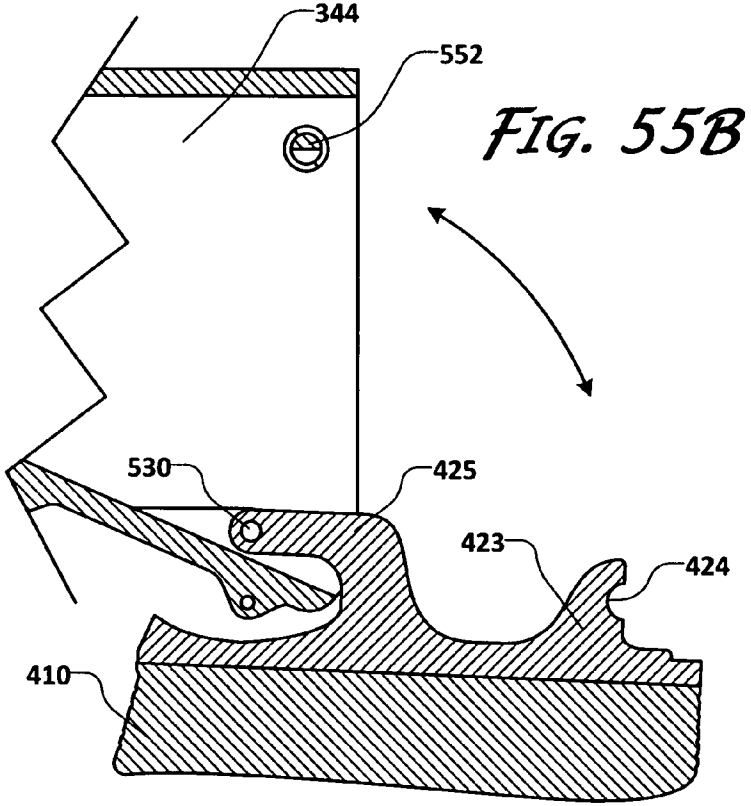
FIG. 55B shows a left side cross-sectional view, taken along line 55-55 of FIG. 35, of an exemplary embodiment of a butt stock assembly according to this invention, wherein the buttplate assembly is attached to a butt stock and is in an opened position.
Figure 55A:
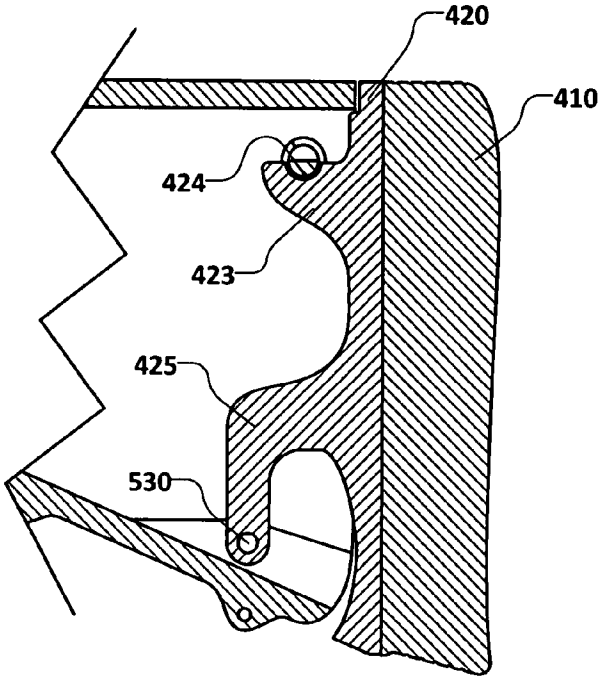
FIG. 55A shows a left side cross-sectional view, taken along line 55-55 of FIG. 35, of an exemplary embodiment of a butt stock assembly according to this invention, wherein the buttplate assembly is attached to a butt stock and is in a closed position.

The attachment leg 425 is substantially L-shaped and extends from the base member 420 an attachment aperture 426 is formed proximate an end of the attachment leg 425. By interaction of an attachment pin 430 with the attachment aperture 426, the buttplate assembly 400 is pivotably coupled to a rear portion of the stock 343. The attachment leg 425 is shaped such that the buttplate assembly 400 can be pivoted from a closed position (as shown in FIG. 55A) to an open position (as shown in FIG. 55B).

When the buttplate assembly 400 is in the open position, a user has access to the internal cavity 344 of the stock 343. When a buttplate assembly 400 is in the closed position, the internal cavity 344 is at least partially sealed.

In various exemplary embodiments, an O-ring may be included on the base member 420 or around the opening of the stock 343 to the cavity 344. If included, the O-ring may provide a more substantial seal between the buttplate assembly 400 and the stock 343, when the buttplate assembly 400 is in the closed position.

A buttplate engaging lever 550 is positioned through a buttplate engaging lever aperture 340 formed through an upper portion of the stock 343. The engaging lever aperture 340 includes a bore hole that extends through the stock 343. A countersunk hole is formed into the surface of the stock 343 to provide a receptacle for the head 551 and locking tab 554 of the engaging lever 550.

Figure 54C:
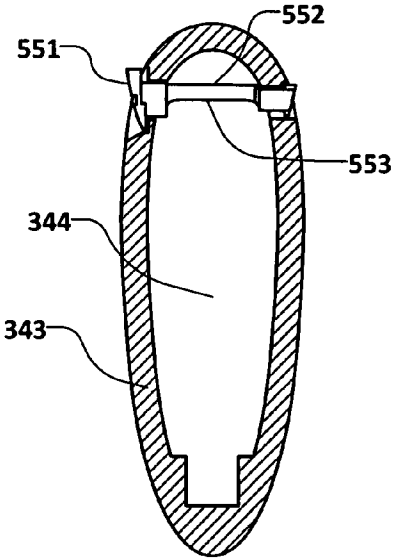
FIG. 54C shows a rear cross-sectional view, taken along line 54-54 of FIG. 52A, of an exemplary embodiment of a stock showing a buttplate engagement lever in a release position according to this invention.
Figure 54B:
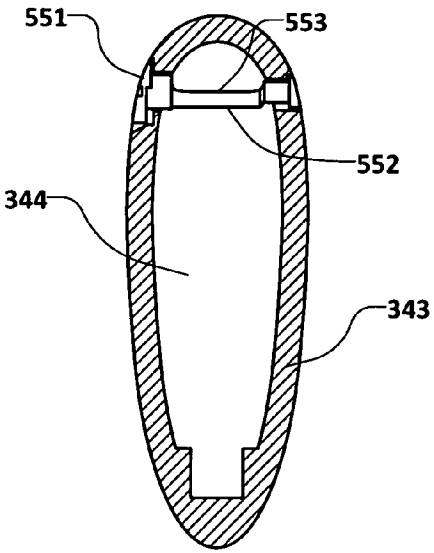
FIG. 54B shows a rear cross-sectional view, taken along line 54-54 of FIG. 52A, of an exemplary embodiment of a stock showing a buttplate engagement lever in a locking position according to this invention.
Figure 54A:
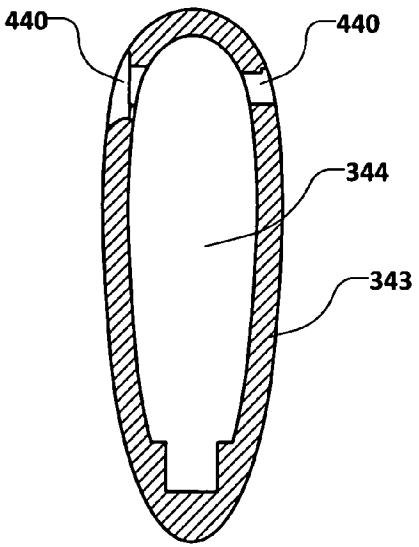
FIG. 54A shows a rear cross-sectional view, taken along line 54-54 of FIG. 52A, of an exemplary embodiment of a stock showing a buttplate engagement lever aperture according to this invention.

The engaging lever 550 comprises a body 552 that extends from a head 551 to a locking tab 554. A release notch 553 is formed in a central portion of the body 552. The body 552 and release notch 553 are formed such that when the engaging lever 550 is in a locking position the body 552 is positioned within the locking notch 424 of the locking leg 423 (when the buttplate assembly 400 is in closed position). When the engaging lever 550 is rotated into a release position, as shown in FIGS. 54C and 55B, the body 552 is removed from the locking notch 424 and the release notch 553 provides a sufficient gap between the engaging lever 550 and the locking leg 423 that the buttplate assembly 400 may be pivoted to an open position. When the buttplate assembly 400 is returned to a close position, the engaging lever 550 can be rotated into a locking position, as shown in FIGS. 54B and 55A, wherein the body 552 is once again positioned within the locking notch 424, such that the buttplate assembly 400 remains in the closed position.

In various exemplary embodiments, the head 551 may include one or more notches, protrusions, or other surface preparations that aid in the rotation of the engaging lever 550 between the locking and release positions.

While the locking leg 423 has been described as having a locking notch 424 formed in a top portion of the locking leg 423, it should be appreciated that the locking notch 424 may be formed in a bottom portion of the locking leg 423. If the locking notch 424 is formed in a bottom portion of the locking leg 423, it should be understood that the locking and release positions of the engaging lever 550 will be reversed.

While this invention has been described in conjunction with the exemplary embodiments outlined above, it is evident that many alternatives, modifications, and variations will be apparent to those skilled in the art.

For example, equivalent elements may be substituted for those specifically shown and described, certain features may be used independently of other features, and the number and configuration of various vehicle components described above may be altered, all without departing from the spirit or scope of the invention as defined in the appended Claims.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting.

Various changes, modifications, and/or adaptations may be made without departing from the spirit and scope of this invention.

What is claimed is:

1. A recoil reduction system, comprising:

a stock having a track formed therein, wherein the track extends to a bottom wall;

a sliding member having a front end, a rear end, a right side, and a left side, wherein the sliding member includes a rail extending from the right side and the left side of the sliding member, and wherein the sliding member slidably interacts with the track by interaction of the track and the rail;

a handgrip member formed as a portion of the stock, wherein the handgrip member includes a chamber that extends within the handgrip member;

a first recoil reduction means mounted within the chamber, wherein the first recoil reduction means is configured to oppose sliding by the sliding member in at least one direction; and a second recoil reduction means that slidably interacts with the track, wherein the second recoil reduction means is configured to oppose sliding by the sliding member in at least one direction.

2. The recoil reduction system of claim 1, wherein the track formed in the stock is an inverted T-shaped track and the rail is an inverted T-shaped rail.

3. The recoil reduction system of claim 1, wherein said first recoil reduction means comprises a spring biased camming lever that interacts with the sliding member.

4. The recoil reduction system of claim 1, wherein the first recoil reduction means comprises a torsion spring connected to a camming means.

5. The recoil reduction system of claim 4, wherein the torsion spring and camming means are configured to pivot about the same axis.

6. The recoil reduction system of claim 1, wherein the first recoil reduction means has reduced rebound.

7. The recoil reduction system of claim 1, wherein the first recoil reduction means comprises a coil spring, a threaded rod surrounded by a coil spring held in place by a nut, a leaf spring, an elastomeric block, or a torsion spring.

8. The recoil reduction system of claim 1, wherein said second recoil reduction means comprises a compression spring that interacts with the sliding member.

9. The recoil reduction system of claim 8, wherein said compression spring is positioned between the bottom wall of the track and the rear wall of the sliding member.

10. The recoil reduction system of claim 8, wherein said compression spring is housed at least partially within a compression spring sleeve.

11. A compound recoil reduction system, comprising:

a camming member having a first end, a middle, and a second end;

a pivot pin pivotally securing the camming member to a recoil reduction means housing;

a spring connected to the camming member;

a compression spring having a first end and a second end; and a sliding member that is configured to be slidably connected to a stock, wherein the camming member and the spring are configured to oppose sliding by the sliding member in at least one direction by interaction of the first end of the caroming member and a first surface of the sliding member, and wherein the compression spring is configured to oppose sliding by the sliding member in at least one direction by interaction of an end of the compression spring and a second surface of the sliding member.

12. The compound recoil reduction system of claim 11, wherein the camming member comprises a cam, and wherein the spring comprises a torsion spring.

13. The compound recoil reduction system of claim 11, wherein a recoil reduction means housing comprises a stock having a handgrip member, a track being formed in the stock, wherein the camming member and spring are mounted in a chamber within the handgrip member, and wherein the sliding member is slidable within the track.

14. The compound recoil reduction system of claim 11, wherein the sliding member is configured to connect to a receiver via a mounting means.

15. The compound recoil reduction system of claim 11, wherein the spring comprises a coil spring, a threaded rod surrounded by a coil spring held in place by a nut, a leaf spring, an elastomeric block, or a torsion spring.

* * * * *

UNITED STATES PATENT AND TRADEMARK OFFICE

CERTIFICATE OF CORRECTION

PATENT NO. : 8,205,371 B1
APPLICATION NO. : 12/657652
DATED : June 26, 2012
INVENTOR(S) : Clifton L. Cook et al.

It is certified that error appears in the above-identified patent and that said Letters Patent is hereby corrected as shown below:

Claim 11, under Column 16, Line 34, delete “caroming” and insert --camming--.

Signed and Sealed this
Fourteenth Day of August, 2012

David J. Kappos

David J. Kappos
*Director of the United States Patent and Trademark Office*